US010481521B2

(12) United States Patent
Soeta et al.

(10) Patent No.: US 10,481,521 B2
(45) Date of Patent: Nov. 19, 2019

(54) DEVELOPING DEVICE HAVING SPACED COVER PORTION AND FRAME

(71) Applicant: CANON KABUSHIKI KAISHA, Tokyo (JP)

(72) Inventors: Yukihiro Soeta, Sagamihara (JP); Masafumi Takahashi, Tsukubamirai (JP); Ryohei Terada, Matsudo (JP); Yushi Sadamitsu, Kashiwa (JP); Yasuhiro Shimoi, Toride (JP); Yutaka Koga, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/926,169

(22) Filed: Mar. 20, 2018

(65) Prior Publication Data

US 2018/0284641 A1 Oct. 4, 2018

(30) Foreign Application Priority Data

Mar. 30, 2017 (JP) ..... 2017-068774
Mar. 30, 2017 (JP) ..... 2017-068777

(51) Int. Cl.
*G03G 15/08* (2006.01)
*G03G 15/09* (2006.01)

(52) U.S. Cl.
CPC ..... *G03G 15/0808* (2013.01); *G03G 15/0815* (2013.01); *G03G 15/0921* (2013.01); *G03G 15/0812* (2013.01); *G03G 15/0898* (2013.01)

(58) Field of Classification Search
CPC ..... G03G 15/0808; G03G 15/0921; G03G 15/167; G03G 15/0865; G03G 15/2053;
(Continued)

(56) References Cited

U.S. PATENT DOCUMENTS 5,768,666 A * 6/1998 Ito ..... G03G 15/0822 399/260
7,103,298 B2 * 9/2006 Satoh ..... G03G 15/0942 399/267

(Continued)

FOREIGN PATENT DOCUMENTS

JP 2015-072331 A 4/2015

OTHER PUBLICATIONS

Ryohei Terada et al., U.S. Appl. No. 15/873,261, filed Jan. 17, 2018.

(Continued)

*Primary Examiner* — David M. Gray
*Assistant Examiner* — Laura Roth
(74) *Attorney, Agent, or Firm* — Venable LLP

(57) ABSTRACT

A developing device includes a rotatable developing member configured to carry a developer containing toner and a carrier to a developing position, a first frame configured to accommodate the developer, a second frame mounted on the first frame and configured to cover part of an outer peripheral surface of the rotatable developing member, and a cover portion provided opposite to the rotatable developing member. The following relationship is satisfied: L1≤L2+L3, and L2≤L3, where with respect to the radial direction of the rotatable developing member, L1 is a minimum of the clearance formed between the second frame and the rotatable developing member, L2 is a minimum of the clearance formed between the rotatable developing member and the cover portion, and L3 is a minimum of the clearance formed between the second frame and the cover portion.

6 Claims, 14 Drawing Sheets

(58) Field of Classification Search
CPC ..... G03G 15/0216; G03G 15/0812; G03G 15/0806; G03G 15/0898; G03G 15/0815; G03G 15/0942; G03G 2215/0609
See application file for complete search history.

(56) References Cited

U.S. PATENT DOCUMENTS

| | | | | |
|---|---|---|---|---|
| 9,244,376 | B2 | 1/2016 | Kuramoto et al. | |
| 9,268,263 | B2 | 2/2016 | Ariizumi et al. | |
| 2004/0114969 | A1* | 6/2004 | Manno | G03G 15/0921 399/272 |
| 2008/0080906 | A1* | 4/2008 | Kawahara | G03G 15/0942 399/277 |
| 2013/0164045 | A1* | 6/2013 | Onoda | G03G 15/081 399/274 |
| 2015/0093139 | A1* | 4/2015 | Kuramoto | G03G 15/0806 399/92 |
| 2017/0205731 | A1* | 7/2017 | Takahashi | G03G 15/0928 |
| 2019/0018346 | A1* | 1/2019 | Ogasawara | G03G 15/0898 |

OTHER PUBLICATIONS

Masafumi Takahashi et al., U.S. Appl. No. 15/926,107, filed Mar. 20, 2018.
Masafumi Takahashi et al., U.S. Appl. No. 15/925,913, filed Mar. 20, 2018.
Takuya Hori et al., U.S. Appl. No. 15/925,900, filed Mar. 20, 2018.
Koji Shigehiro et al., U.S. Appl. No. 15/729,950, filed Oct. 11, 2017.

* cited by examiner

DEVELOPING DEVICE HAVING SPACED COVER PORTION AND FRAME

FIELD OF THE INVENTION AND RELATED ART

The present invention relates to a developing device including a developer carrying member rotatable while carrying a developer, and relates to an image forming apparatus, including the developing device, such as a copying machine, a printer, a facsimile machine or a multifunction machine having a plurality of functions of these machines.

An image forming apparatus of an electrophotographic type or an electrostatic recording type includes a developing device for developing an electrostatic latent image, with a developer such as toner, formed on a photosensitive drum as an image bearing member. The developing device includes a developing sleeve as a developer carrying member rotatable while carrying a developer and supplies the developer, carried on the developing sleeve, to the photosensitive drum provided with a gap from the developing sleeve.

In the case of such a developing device, there is a liability that air flows from the gap between the developing sleeve and the photosensitive drum into a developing container constituting the developing device due to rotation of the developing sleeve and atmospheric pressure in the developing container increases correspondingly and thus the developer in the developing container is scattered to an outside of the developing container through the gap between the developing sleeve and the photosensitive drum. Therefore, a constitution in which an inner cover is provided between an outer cover of the developing container and the developing sleeve and the air flowing through between the developing sleeve and the inner cover into the developing container is discharged through between the inner cover and the outer cover has been proposed (Japanese Laid-Open Patent Application (JP-A) 2015-72331).

However, in the case of the constitution disclosed in JP-A 2015-72331, there is a liability that the air containing the developer passes, in the direction opposite to an inflow direction, through an inflow path, between the pressure and the inner cover, for permitting flowing of the air into the developing container and thus is discharged to an outside of the developing container through the gap between the developing sleeve and the photosensitive drum. For this reason, there was a possibility that scattering of the developer cannot be sufficiently suppressed.

SUMMARY OF THE INVENTION

A principal object of the present invention is to provide a constitution capable of sufficiently suppressing scattering of a developer to an outside of a developing container.

According to an aspect of the present invention, there is provided a developing device comprising: an accommodating casing configured to accommodate a developer; a rotatable developer carrying member provided in the accommodating casing and configured to develop, in a developing region, an electrostatic latent image formed on an image bearing member; a regulating portion provided below the developer carrying member with respect to a vertical direction and configured to regulate an amount of the developer on the developer carrying member; a magnetic flux generating portion provided inside the developer carrying member and including a first magnetic pole provided downstream of the developing region with respect to a rotational direction of the developer carrying member and a second magnetic pole which is provided adjacently downstream of the first magnetic pole with respect to the rotational direction and which has a polarity identical to a polarity of the first magnetic pole; and a cover portion provided downstream of the developing region and upstream of a maximum magnetic flux density position of the second magnetic pole with respect to the rotational direction, the cover portion being disposed between the casing and the developer carrying member over a rotational axis direction of the developer carrying member with a gap between itself and the casing and with a gap between itself and the developer carrying member, wherein a first opposing region between an inner surface of the casing and the developer carrying member is in a side downstream of the developing region and upstream of a second opposing region between the cover portion and the developer carrying member with respect to the rotational direction, and wherein the following relationships are satisfied: $L1 \leq L2+L3$, and $L2 \leq L3$, where L1 is a minimum distance between the developer carrying member and the accommodating casing in the first opposing region, L2 is a minimum distance between the developer carrying member and the cover portion in the second opposing region, and L3 is a minimum distance between the cover portion and the accommodating portion opposing the cover portion.

Further features of the present invention will become apparent from the following description of exemplary embodiments with reference to the attached drawings.

DESCRIPTION OF EMBODIMENTS

<First Embodiment>

The First Embodiment (Embodiment 1) will be described with reference to FIGS. 1 to 10. First, a general structure of an image forming apparatus in this embodiment will be described using FIGS. 1 and 2.

[Image Forming Apparatus]

An image forming apparatus 100 in this embodiment is a tandem(-type) full-color printer of an electrophotographic type, in which four image forming portions PY, PM, PC and PK each including a photosensitive drum 1 as an image bearing member are provided. The image forming apparatus 100 forms a toner image (image) on a recording material depending on an image signal from a host device such as an original reading device (not shown) connected with an apparatus main assembly 100A or a personal computer communicatably connected with the apparatus main assembly 100A. As the recording material, a sheet material such as a sheet, a plastic film or a cloth can be cited. Further, the image forming portions PY, PM, PC and PK form toner images of yellow, magenta, cyan and black, respectively.

The four image forming portions PY, PM, PC and PK provided in the image forming apparatus 100 have the substantially same constitution except that colors of developers are different from each other. Accordingly, the image forming portion PY will be described as a representative and other image forming portions will be omitted from description.

Figure 2:
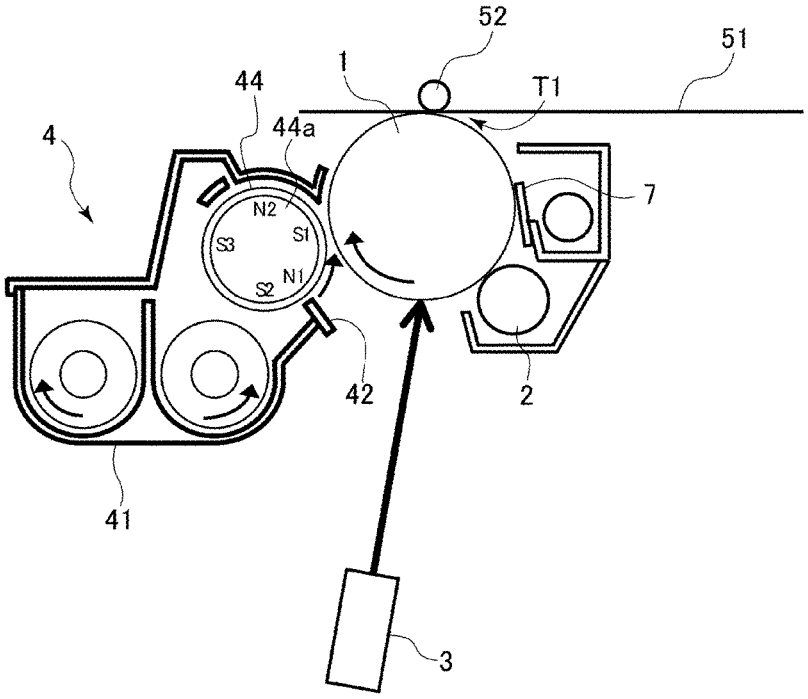
FIG. 2 is a schematic sectional view of an image forming portion in the First Embodiment.

As shown in FIG. 2, at the image forming portion PY, a cylindrical photosensitive member as the image bearing member, i.e., the photosensitive drum 1 is provided. The photosensitive drum 1 is rotationally driven in an arrow direction in the figure. At a periphery of the photosensitive drum 1, a charging roller 2 as a charging means, a developing device 4, a primary transfer roller 52 as a transfer means, and a cleaning device as a cleaning means are provided. Below the photosensitive drum 1 in the figure, an exposure device (a laser scanner in this embodiment) 3 as an exposure means is provided.

Figure 1:
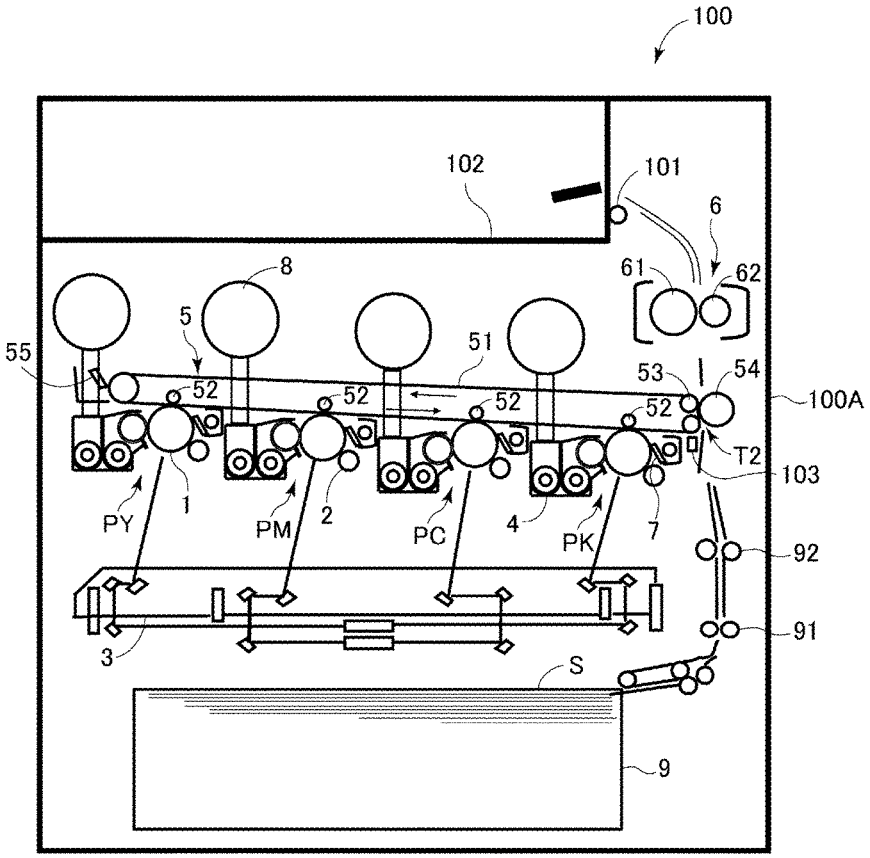
FIG. 1 is a schematic sectional view of an image forming apparatus according to a First Embodiment.

Above the respective image forming portions in FIG. 1, a transfer device 5 is provided. In the transfer device 5, an endless intermediary transfer belt 51 as an intermediary transfer member is stretched by a plurality of rollers and is constituted so as to be circulated (rotated) in an arrow direction. The intermediary transfer belt 51 carries and feeds the toner images which are primary-transferred on the intermediary transfer belt 51 as described later. At a position opposing an inner secondary transfer roller 53, of the rollers stretching the intermediary transfer belt 51, while sandwiching the intermediary transfer belt 51 between itself and the inner secondary transfer roller 53, an outer secondary transfer roller 54 as a secondary transfer means is provided and constitutes a secondary transfer portion T2 for transferring the toner images from the intermediary transfer belt 51 onto the recording material. A fixing device 6 is provided downstream of the secondary transfer portion T2 with respect to a recording material feeding direction.

At a lower portion of the image forming apparatus 100, a cassette 9 in which the recording material S is accommodated is provided. The recording material S fed from the cassette 9 is fed toward a registration roller pair 92 by a feeding roller pair 91. A leading end of the recording material S abuts against the registration roller pair 92 which is in a rest state, and forms a loop, so that oblique movement of the recording material S is corrected. Thereafter, rotation of the registration roller pair 92 is started in synchronism with the toner images on the intermediary transfer belt 51, so that the recording material S is fed to the secondary transfer portion T2.

A process of forming, for example, a four-color-based full-color image by the image forming apparatus 100 constituted as described above will be described. First, when an image forming operation is started, a surface of a rotating photosensitive drum 1 is electrically charged uniformly by the charging roller 2. Then, the photosensitive drum 1 is exposed to laser light, corresponding to an image signal, emitted from the exposure device 3. As a result, an electrostatic latent image corresponding to the image signal is formed on the photosensitive drum 1. The electrostatic latent image on the photosensitive drum 1 is visualized by toner as the developer accommodated in the developing device 4 and is formed in a visible image (toner image).

The toner image formed on the photosensitive drum 1 is primary-transferred onto the intermediary transfer belt 51 at a primary transfer portion T1 (FIG. 2) constituted between the photosensitive drum 1 and a primary transfer roller 52 provided while sandwiching the intermediary transfer belt 51 between itself and the photosensitive drum 1. At this time, to the primary transfer roller 52, a primary transfer bias is applied. Toner (transfer residual toner) remaining on the surface of the photosensitive drum 1 after the primary transfer is removed by the cleaning device 7.

Such an operation is successively performed at the respective image forming portions for yellow, magenta, cyan and black, so that the four color toner images are superposed on the intermediary transfer belt 51. Thereafter, in synchronism with timing of toner image formation, the recording material S accommodated in the cassette 9 is fed to the secondary transfer portion T2. Then, by applying a secondary transfer bias to the outer secondary transfer roller 54, the four color toner images are secondary-transferred altogether from the intermediary transfer belt 51 onto the recording material S. Toner remaining on the intermediary transfer belt 51 without being completely transferred onto the recording material S at the secondary transfer portion T2 is removed by an intermediary transfer belt cleaner 55.

Then, the recording material S is fed to the fixing device 6 as a fixing means. In the fixing device 6, a fixing roller 61 including a heat source such as a halogen heater and a pressing roller 62 are provided, and a fixing nip is formed by the fixing roller 61 and the pressing roller 62. The recording material S on which the toner recording materials are transferred is passed through the fixing nip, so that the recording material S is heated and pressed. Then, the toners on the recording material S are melted and mixed with each other and are fixed as a full-color image on the recording material S. Thereafter, the recording material S is discharged onto a discharging tray 102 by a discharging roller 101. As a result, a series of image forming process operations is ended.

Incidentally, the image forming apparatus 100 in this embodiment is also capable of forming a single-color image, such as a back (monochromatic) image, or a multi-color image by using the image forming portion(s) for a desired single color or for some colors of the four colors.

[Developing Device]

A detailed structure of the developing device 4 will be described using FIGS. 3 and 4. The developing device 4 includes a developing container 41 for accommodating non-magnetic toner and a magnetic carrier and includes a developing sleeve 44 as a developer carrying member rotating while carrying the developer in the developing container 41. In the developing container 41, feeding screws 43*a* and 43*b* as developer feeding members for circulating the developer in the developing container 41 while stirring and feeding the developer in the developing container 41 are provided. Inside the developing sleeve 44, a magnet 44*a* as a maximum flux generating means including a plurality of magnetic poles with respect to a circumferential direction is non-rotatably provided. Further, a developing blade 42 as a regulating member for forming a thin layer of the developer on a surface of the developing sleeve 44 is provided.

Figure 3:
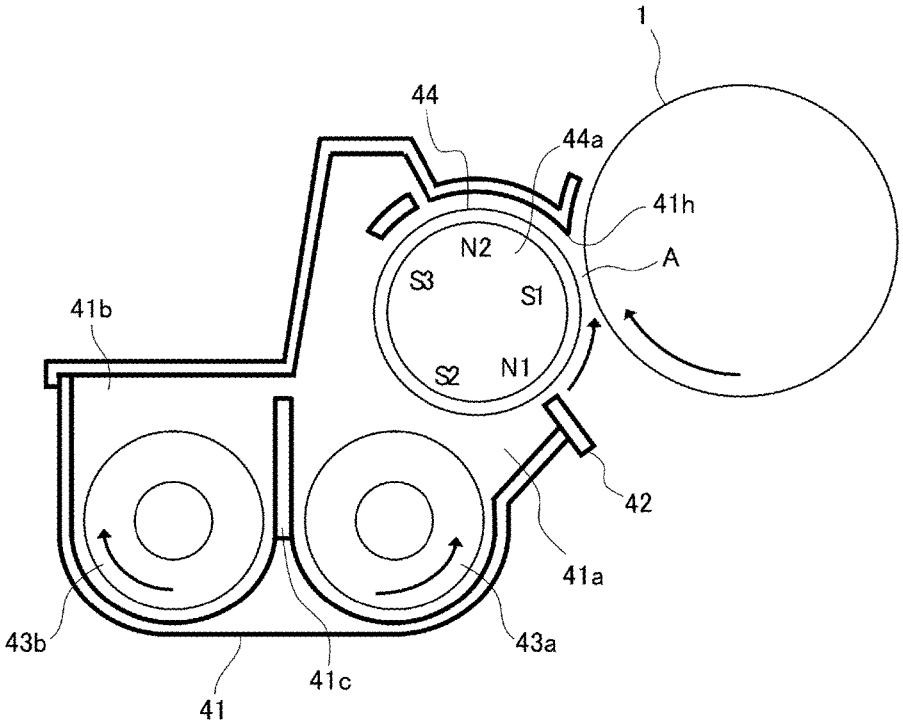
FIG. 3 is a schematic cross-sectional view of a developing device in the First Embodiment.

Inside the developing container 41, a substantially central portion thereof is partitioned into left and right portions with respect to a horizontal direction, i.e., into a stirring chamber 41*b* and a developing chamber 41*a* by a partition wall 41*c* extending in a direction perpendicular to the surface of the drawing sheet of FIG. 3, and the developer is accommodated in the developing chamber 41*a* and the stirring chamber 41*b*. In the developing chamber 41*a* and the stirring chamber 41*b*, the feeding screws 43*a* and 43*b* are disposed, respectively. At end portions of the partition wall 41*c* with respect to a longitudinal direction (i.e., at end portions of the developing sleeve 44 with respect to a rotational axis direction, left side and right side of FIG. 4), delivering portions 41*d* and 41*e* for permitting passing of the developer between the developing chamber 41*a* and the stirring chamber 41*b* are provided.

Each of the feeding screws 43*a* and 43*b* is formed by providing a helical blade as a feeding portion around a shaft (rotation shaft) of a magnetic material. Further, the feeding screw 43*b* is provided, in addition to the helical blade, with stirring ribs 43*b*1 each having a predetermined width with respect to a developer feeding direction so as to project from the shaft in a radial direction of the shaft. The stirring ribs 43*b*1 stir the developer with rotation of the shaft.

The feeding screw 43*a* is disposed at a bottom portion of the developing chamber 41*a* along the rotational axis direction of the developing sleeve 44, and feeds the developer to the developing sleeve 44 while feeding the developer in the developing chamber 41*a* along an axial direction by rotating the rotation shaft by an unshown motor. The developer which is carried on the developing sleeve 44 and of which toner is consumed in a developing step is collected in the developing chamber 41*a*.

The feeding screw 43*b* is disposed at a bottom portion of the stirring chamber 41*b* along the rotational axis direction of the developing sleeve 44, and feeds the developer in the stirring chamber 41*b* along an axial direction in a direction opposite to the developer feeding direction of the feeding screw 43*a*. The developer is fed by the feeding screws 43*a* and 43*b* in this manner, and is circulated in the developing container 41 through the delivering portions 41*d* and 41*e*.

At an upstream end portion of the stirring chamber 41*b* with respect to the developer feeding direction of the feeding screw 43*b*, a developer supply opening 46 for permitting supply of the developer containing the toner into the developing container 41 is provided. The developer supply opening 46 is connected with a supplying and feeding portion 83 of a developer supplying device 80 shown in FIG. 5 and described later. Accordingly, a developer for supply is supplied from the developer supplying device 80 into the stirring chamber 41*b* through the supplying and feeding portion 83 and the developer supply opening 46. The feeding screw 43*b* feeds the developer supplied through the developer supply opening 46 and the developer which has already been in the stirring chamber 41*b* while stirring these developers, so that a toner content (concentration) is uniformized.

Figure 4:
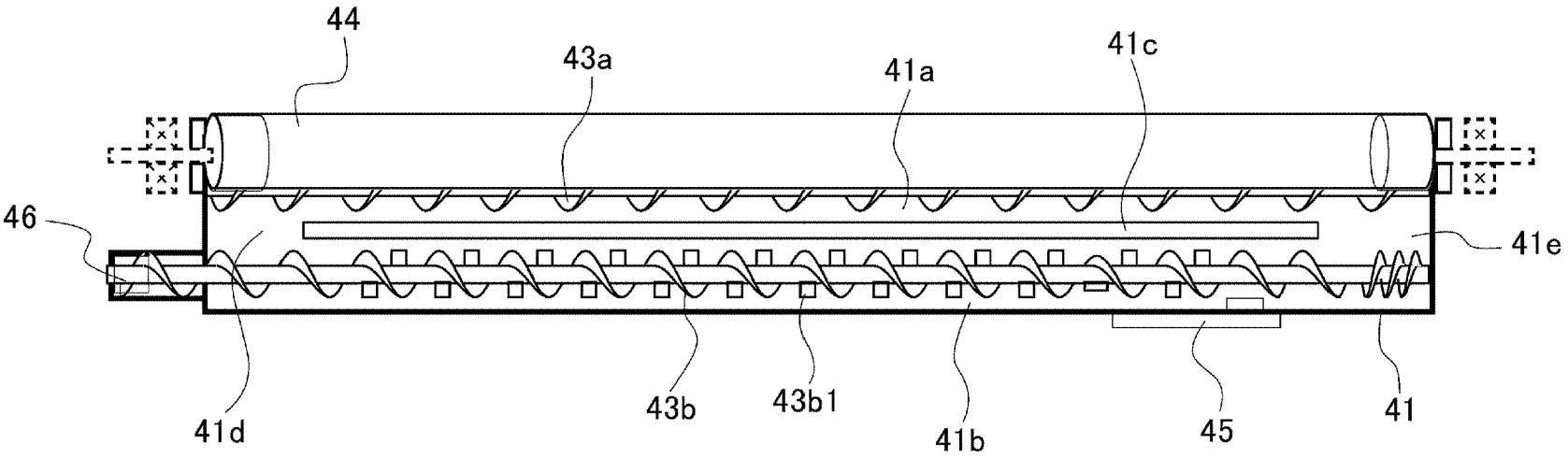
FIG. 4 is a schematic longitudinal sectional view of the developing device in the First Embodiment.

Accordingly, by feeding forces of the feeding screws 43*a* and 43*b*, the developer in the developing chamber 41*a* in which the toner is consumed in the developing step and thus the toner content is lowered is moved into the stirring chamber 41*b* through one delivering portion 41*d* (left side of FIG. 4). Then, the developer moved in the stirring chamber 41*b* is fed while being stirred with the supplied developer and is moved into the developing chamber 41*a* though the other delivering portion 41*e* (right side of FIG. 4).

The developing chamber 41*a* of the developing container 41 is provided with an opening 41*h* at a position corresponding to an opposing region (developing region) A opposing the photosensitive drum 1, and in this opening 41*h*, the developing sleeve 44 is rotatably provided so as to be partially exposed in a direction of the photosensitive drum 1. On the other hand, the magnet 44*a* incorporated in the developing sleeve 44 is non-rotationally fixed. Such a developing sleeve 44 is rotated by an unshown motor, and is capable of feeding the developer to the opposing region A, and feeds the developer to the photosensitive drum 1 in the opposing region A. In this embodiment, the developing sleeve 44 is formed, in a cylindrical shape, of a non-maximum material such as aluminum or stainless steel. The developing sleeve 44 rotates from below toward above with respect to a direction of gravitation in the opposing region A, i.e., rotates in a counterclockwise direction of FIG. 3.

In a side upstream of the opening 41*h* with respect to the rotation direction of the developing sleeve 44, the developing blade 42 as a regulating member for regulating an amount of the developer carried on the developing sleeve 44 is fixed. In this embodiment, the developing sleeve 44 rotates in the opposing region A from below toward above with respect to the direction of gravitation, and therefore, the developing blade 42 is positioned below the opposing region A with respect to the direction of gravitation.

The magnet 44*a* includes, as shown in FIG. 3, 5 magnetic poles in total consisting of a plurality of magnetic poles S1, S2, S3, N1 and N2 with respect to a circumferential direction and is formed in a roller shape. The developer in the developing chamber 41*a* is supplied to the developing sleeve 44 by the feeding screw 43*a*, and the developer supplied to the developing sleeve 44 is carried in a predetermined amount on the developing sleeve 44 by a magnetic field generated by an attracting magnetic pole S2 of the magnet 44*a*, and forms a developer accumulating portion.

The developer on the developing sleeve 44 passes through the developer accumulating portion by rotation of the developing sleeve 44 and is erected by a regulating magnetic pole N1, and a layer thickness thereof is regulated by the developing blade 42 opposing the regulating magnetic pole N1. Then, the developer subjected to the layer thickness regulation is fed to the opposing region A opposing the photosensitive drum 1 and is erected by a developing magnetic pole S1, and forms a magnetic chain. This magnetic chain contacts the photosensitive drum 1 rotating in the same direction as the rotational direction of the developing sleeve 44 in the opposing region A, so that the electrostatic latent image is developed into the toner image with the charged toner.

Thereafter, the developer on the developing sleeve 44 is fed into the developing container 41 by the rotation of the developing sleeve 44 while attraction of the developer to the surface of the developing sleeve 44 is maintained by a feeding magnetic pole N2. Then, the developer carried on the developing sleeve 44 is peeled off the surface of the developing sleeve 44 by a peeling magnetic pole S3 and is collected in the developing chamber 41*a* of the developing container 41.

In the developing container 41, as shown in FIG. 4, an inductance sensor 45 as a toner content sensor for detecting a toner content in the developing container 41 is provided. In this embodiment, the inductance sensor 45 is provided downstream of the stirring chamber 41*b* with respect to the developer feeding direction.

[Developing Supplying Device]

Figure 5:
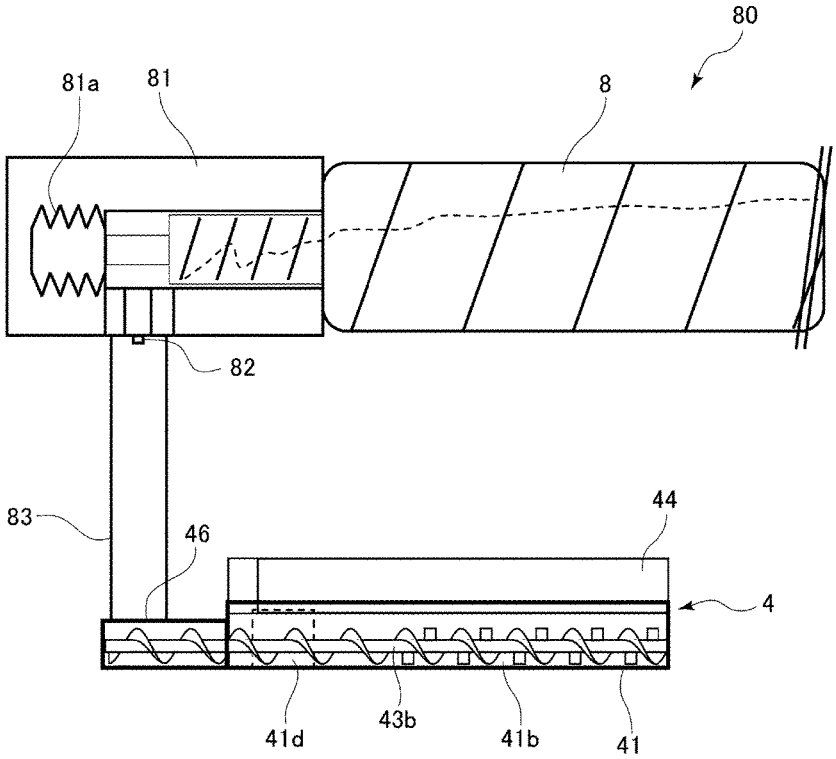
FIG. 5 is a schematic sectional view of a supplying device and the developing device in the First Embodiment.

The developer supplying device 80 will be described using FIG. 5. The developer supplying device 80 includes an accommodating container 8 for accommodating the developer for supply and includes a supplying mechanism 81 and a supplying and feeding portion 83. The accommodating container 8 has a constitution such that a helical groove is provided on an inner wall of a cylindrical container, so that a feeding force for feeding the developer in a longitudinal direction (rotational axis direction) by rotation of the accommodating container 8 itself. The accommodating container 8 is connected with the supplying mechanism 81 at a downstream end portion thereof with respect to the developer feeding direction. The supplying mechanism 81 includes a pump portion 81*a* for discharging the developer, fed from the accommodating container 8, through a discharge opening 82. The pump portion 81*a* is formed in a bellow shape and changes in volume by being rotationally driven, so that air pressure generates and thus the developer fed from the accommodating container 8 is discharged through the discharge opening 82.

To the discharge opening 82, an upstream end portion of the supplying and feeding portion 83 is connected, and a lower end portion of the supplying and feeding portion 83 is connected to a developer supply opening 46 of the developing device 4. That is, the developer supplying and feeding portion 83 communicates the discharge opening 82 and the developer supply opening 46 with each other. Accordingly, the developer discharged through the discharge opening 82 by the pump portion 81*a* passes through the developer supplying and feeding portion 83 and is supplied into the developing container 41 of the developing device 4.

In the above-described developing device 4, the developer supply opening 46 is provided upstream of the stirring chamber 41*b* with respect to the developer feeding direction and outside a circulating path, of the developer, formed by the developing chamber 41*a* and the stirring chamber 41*b*. Specifically, the developer supply opening 46 is provided upstream of one delivering portion 41*d* with respect to the developer feeding direction of the stirring chamber 41*b*. Accordingly, in the neighborhood of the developer supply opening 46, the developer in the developer circulating path little exists, and the developer for supply only passes.

Such supply by the developer supplying device 80 is carried out by automatic toner replenisher (ATR) control. This ATR control is such that an operation of the developer supplying device 80 is controlled depending on an image ratio during image formation, the toner content detected by the inductance sensor 45, and a density detection result of a patch image by a density sensor 103 (FIG. 1) for detecting a density of the toner, and thus the developer is supplied (replenished) to the developing device 4.

The density sensor 103 is, as shown in FIG. 1, provided downstream of the most downstream image forming portion PY and upstream of the secondary transfer portion T2 with respect to the rotational direction of the intermediary transfer belt 51 so as to oppose the intermediary transfer belt 51. In control using the density sensor 103, for example, at timing such as the time of a start of an image forming job or every image formation of a predetermined print number, a toner image for control (patch image) is transferred onto the intermediary transfer belt 51 and the density of the patch image is detected by the density sensor 103. Then, on the basis of this detection result, supply control of the developer by the developer supplying device 80 is carried out.

Incidentally, the constitution of supplying the developer to the developing device 4 is not limited to such a constitution, but a conventionally known constitution may also be employed.

[Scattering of Developer]

Here, scattering of the developer generating from the developing device 4 will be described. First, as regards the image forming apparatus, not only speed-up and image quality improvement of an output image but also simplification of maintenance are required. As one of the methods of the simplification of maintenance, a lowering in degree of contamination of the inside of the image forming apparatus with the developer can be cited. When the inside of the image forming apparatus is contaminated with the developer, an image defect such as contamination of the output image generates, and a cleaning operation is required at the time of exchange of the developing device, the photosensitive drum or the like in some cases. Further, in the case where the developer is deposited on respective during systems such as gears, there is a liability that a slip generates in the driving systems.

As one of the causes of the above-described contamination of the inside of the image forming apparatus with the developer, scattering of the developer from the inside of the developing device can be cited. For example, in the case of a two-component developer, usually, inside the developing device, the toner and the carrier are triboelectrically charged with each other, and therefore, the toner and the carrier are attracted to each other by an electrostatic force. However, there is a liability that due to some impact (shock), scattering of the developer such that this attraction is released (eliminated) and the toner liberated from the carrier is discharged together with air from the inside of the developing device generates.

A specific example of the scattering of the developer will be described using a developing device 400 in a comparison example shown in FIG. 6. The developing device 400 has the same constitution as that of the above-described developing device 4 except that a constitution of a developing container 401 is different from the constitution of the above-described developing container 41. For this reason, the same constituent elements will be described by adding the same reference numerals or symbols. To the developing device 400, similarly as in the case of the above-described developing device 4, the supplying and feeding portion 83 of the developer supplying device 80 is connected.

The developing container 401 includes an upper cover 402 for covering a portion above the developing sleeve 44. Further, between the upper cover 402 and the developing sleeve 44, a flow path of air flowing into the developing container 401 by rotation of the developing sleeve 44 is formed. This flow path opens at a position opposing the photosensitive drum 1, so that the scattering of the developer from the inside of the developing device principally generates from this flow path. This is because on a side opposite from this flow path (on a lower side of FIG. 6), the developing blade 42 is close to and opposes the developing sleeve 44. That is, at this position, a state in which a layer thickness of the developer carried on the developing sleeve 44 is regulated by the developing blade 42 is formed, so that the air does not readily flow out from a gap between the developing sleeve 44 and the developing blade 42.

Here, the scattering of the developer refers to that the developer such as liberated toner or the like generating in the developing container 401 by stirring and feeding of the developer or by supply of the developer passes through an opening of the flow path and is discharged to an outside of the developing container 401 and is not completely collected in the developing container 401.

First, toner liberation will be described. The toner and the carrier which are accommodated in the developing container 401 are triboelectrically charged with each other in the stirring chamber 41*b* and the developing chamber 41*a* and are attracted to each other by an electrostatic attraction (deposition) force generated due to the triboelectric charge and by a non-electrostatic attraction force generated due to a surface property or the like. When an impact or a shearing force is exerted on the toner deposited on the carrier, the toner is peeled off the carrier and thus is liberated from the carrier in the developing container 401. As the impact or the shearing force at this time, behavior of the developer during feeding of the developer by the developing sleeve 44 is cited.

The developer forms, on the developing sleeve 44, a magnetic chain which is a chain-like structure along magnetic lines of force of inside magnetic poles. This magnetic chain raises formed with respect to the rotational direction immediately in front of the magnetic pole and falls formed with respect to the rotational direction when the magnetic chain passes through the magnetic pole. In this case, the rotational direction of the magnetic chain is the same as the rotational direction of the developing sleeve 44. By an impact and a centrifugal force when the magnetic chain falls, the toner is peeled off the carrier. This causes toner liberation.

The magnetic pole largely contributing to the toner liberation when the developer is fed by the developing sleeve 44 is the peeling magnetic pole S3 generating a repulsive magnetic field between itself and the attracting magnetic pole S2. At this peeling magnetic pole S3, in order to peel the developer off the developing sleeve 44, a magnetic force in a direction opposite to the rotational direction of the developing sleeve 44 is applied by the magnetic pole, so that a speed of the fed developer is lowered and thus the developer is stagnated. At this time, a length of the magnetic chain increases, and therefore, there is a tendency that the impact and the centrifugal force when the magnetic chain falls become large and thus a toner liberation amount increases.

Further, also the developer rose into the air before being sufficiently stirred when the developer is supplied from the developer supplying device 80 to the developer supply opening 46 causes the liberated toner in the developing container 401. The toner supplied to the developer supply opening 46 is fed while being stirred with the developer which has already existed in the stirring chamber 41*b*. At this time, in a mixing region of the developer for supply and the already-existing developer, a mixing ratio between the toner and the developer temporarily increases. In the case where the mixing ratio between the toner and the developer is high, a charge amount of the toner lowers, so that an electrostatic depositing force between the toner and the carrier lowers. The toner which is not completely mixed with the developer is liberated as it is or by the impact by the feeding screws 43*a* and 43*b* during stirring and feeding of the developer, so that the liberated toner rises into the air in the developing container 401.

Further, in the case where the developer device 80 from which the developer is discharged by the air pressure generated by the pump portion 81*a* is used, the air pressure is transmitted through the supplying and feeding portion 83, so that the air flows into the developing container 401 through the developer supply opening 46 in some cases. At this time, an air stream flowing into the developing container 401 raises, into the air in the developing container 401, the liberated toner at a portion where the mixing ratio between the developer and the toner in the neighborhood of the developer supply opening 46 is high. Further, the air pressure transmission to the developing container 401 causes unsteady rise of the atmospheric pressure from the developer supply opening 46 to the stirring chamber 41*b*. This rise of the atmospheric pressure causes the flowing of the liberated toner to the outside of the developing container 401 as described later. Particularly, such inflow of the air by the supply of the developer constitutes one of the factors of the scattering of the developer at an end portion, including the developer supply opening 46, with respect to a longitudinal direction of the developing container 401 (the rotational axis direction of the developing sleeve 44).

Next, using FIG. 6, the air stream inside and in the neighborhood of the developing device 400 will be described. The air stream is generated in the neighborhood of the developing device 400 by the developing sleeve 44 and the photosensitive drum 1 in the following manner. First, by the rotation of the developing sleeve 44 and behavior of the magnetic chain on the magnetic pole, the air stream is generated in the substantially same direction as the rotational direction of the developing sleeve 44. This air stream generated in the substantially same direction as the rotational direction of the developing sleeve 44 takes the air into the developing container 401 through a communication opening between the inside and the outside of the developing container 401. Further, the air flows into the developing container 401 also by the supply of the developer.

Assuming that the developing container 401 is a substantially closed space, the air is gas, and therefore, continuity equation is applicable. When a flow rate of the air is v and a density of the air is ρ, there is no source flow of the air in the developing container 401, and therefore, the following formula (1) holds.

$$\partial\rho/\partial t+\nabla\rho v=0 \quad (1)$$

When a steady state is considered, in respective regions in the developing container 401, the density ρ is roughly constant and therefore, the formula (1) can be represented by the following formula (2).

$$\rho\nabla v=0 \quad (2)$$

From this formula (2), a flow rate pv of the air is conserved. In a longitudinal cross-section in the neighborhood of the developing device 400, income and expenditure of the flow rate ρv is 0, so that the air is discharged to the outside of the developing device 400 in the same amount as the flow rate of the air flowing into the developing container 401 by the developing sleeve 44 and the supply of the developer. Here, the flow rate of the air flowing into the developing container 401 through a communication opening, constituted by the upper cover 402 of the developing container 401 and by the developing sleeve 44, with rotation of the developing sleeve 44 is Qa (sleeve inflow). Further, the air stream discharged through the communication opening between the inside and the outside of the developing container 401 passes through the upper cover 402 side so as to oppose the flow of the air taken through this communication opening. The flow rate of the thus discharged air stream is Qb (sleeve discharge). Further, when the flow rate of the air stream flowing into the developing container 401 with the supply of the developer to the developing device 400 is Qd (supply inflow), a relationship of the following formula (3) holds.

$$Qa \text{ (sleeve inflow)} + Qd \text{ (supply inflow)} = Qb \text{ (sleeve discharge)} \quad (3)$$

The air stream taken by the developing sleeve 44 and flowing along the developing sleeve 44 is turned back in the developing container 401 and then is discharged. At this time, at the developer stagnation portion of the peeling magnetic pole S3, when the air stream including the developer peeled off the developing sleeve 44 is turned back, the air stream moves toward a discharge direction while containing, in a large amount, the developer such as the liberated toner generated in the developing container 401.

A step in which the developer contained in the sleeve discharge air (flow rate Qb) is discharged to the outside of the developing container 401 is principally constituted by the following two component steps (factors). A first component step (factor) is such that the sleeve discharge air (flow rate Qb) discharged to the outside of the developing device 400 through the communication opening is directly discharged from a gap between the upper cover 402 and the photosensitive drum 1. A second component step (factor) is such that the sleeve discharge air (flow rate Qb) is mixed, in the neighborhood of the photosensitive drum 1, with the developer carried on the developing sleeve 44 or the developer is transferred, by force of inertia, to an air streaming generated by rotation of the photosensitive drum 1 and is then discharged while being carried on the air stream g.

The scattering of the developer is caused by discharge of the developer to the outside of the developer due to at least one factor of the above-described two factors (component steps). Then, the scattered developer contaminates the periphery of the developing device 400, an outer wall of the developing container 401, the photosensitive drum 1, the exposure device 3 and the transfer device 5.

[Structure of Developing Container in this Embodiment]

Therefore, in this embodiment, the developing container 41 of the developing device 4 is constituted as follows. A detailed structure of the developing container 41 in this embodiment will be described using FIG. 7. Incidentally, angles θ1 to θ6 are angles which are based on a horizontal plane H passing through a center opening of the developing sleeve 44 and which are formed by a line segment connecting the center opening and an objective position and by a plane (vertical plane) P perpendicular to the horizontal plane H passing through the center O.

Figure 7:
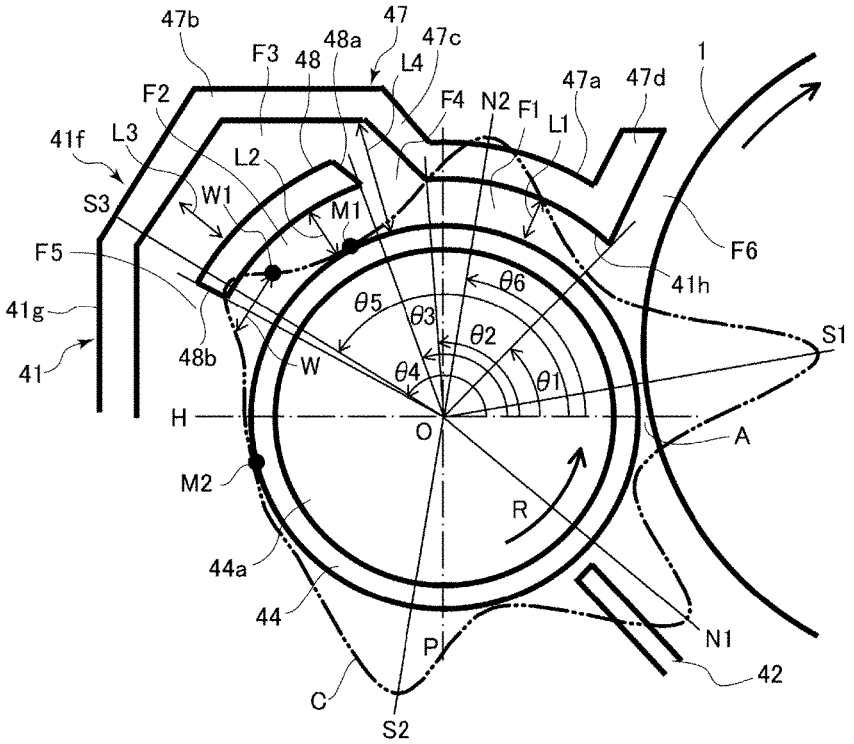
FIG. 7 is a sectional view of a periphery of a developing sleeve of the developing device in the First Embodiment.

Further, a curve C shown at a periphery of FIG. 7 shows a distribution of magnetic flux density of the respective magnetic poles. Further, a rotational direction of the developing sleeve 44 is R. Of the respective magnetic poles of the magnet 44*a*, with respect to the rotational direction R, the peeling magnetic pole S3 disposed downstream of the opposing region A and the attracting magnetic pole S3 which is disposed adjacently downstream of the peeling magnetic pole S3 and which has the same polarity as the polarity of the peeling magnetic pole S3 correspond to a first magnetic pole and a second magnetic pole, respectively. In FIG. 7, positions of the respective magnetic poles are represented by lines showing peak positions of the magnetic flux density of the respective magnetic poles.

The developing container 41 in this embodiment includes an upper cover 41*f* for covering the developing sleeve 44 on a side downstream of the opposing region A with respect to the rotational direction R of the developing sleeve 44. The upper cover 41*f* includes an outer cover 47 as a first covering portion and an inner cover 48 as a second covering portion. The outer cover 47 is disposed downstream of the opposing region A with respect to the rotational direction R and covers the developing sleeve 44 with a gap.

The inner cover 48 is disposed between the outer cover 47 and the developing sleeve 44 so as to provide a gap between itself and the outer cover 47 and a gap between itself and the developing sleeve 44 and covers the developing sleeve 44. A part of the inner cover 48 opposes a part of the outer cover 47 with the gap along the rotational direction R. In this embodiment, an upstream end 48*a* of the inner cover 48 with respect to the rotational direction R of the developing sleeve 44 is opposed to a part of the outer cover 47 with a gap with respect to the rotational direction R.

Further, the upstream end 48*a* of the inner cover 48 with respect to the rotational direction R is positioned above the developing sleeve 44 in a side downstream, with respect to the rotational direction R, a perpendicular plane (vertical plane) P passing through a top (point) of the developing sleeve 44 with respect to a vertical direction. That is, the upstream end 48*a* of the inner cover 48 is positioned downstream of a portion vertically above the top of the developing sleeve 44. In other words, the upstream end 48*a* of the inner cover 48 is positioned on the inside (downstream side with respect to the rotational direction R) of the developing container 41 more than the perpendicular plane P passing through a center O of the developing sleeve 44.

A downstream end 48*b* of the inner cover 48 with respect to the rotational direction R is positioned in a side downstream of a position of an upstream minimum M1 of a pair of minimums M1 and M2, with respect to the rotational direction R, in terms of an absolute value of a magnetic flux density distribution of the peeling magnetic pole S3.

Incidentally, the rotational direction downstream end 48*b* of the inner cover 48 may preferably be positioned at an upstream end W1, with respect to the rotational direction R of the developing sleeve 44, of a half-width W of the magnetic flux density of the peeling magnetic pole S3 or positioned in a side downstream of the upstream end W1 of the half-width W with respect to the rotational direction R. The rotational direction downstream end 48*b* of the inner cover 48 may more preferably be positioned at a peak position of the magnetic flux density of the peeling magnetic pole S3 or positioned in a side downstream of the peak position with respect to the rotational direction R. By disposing the position of the rotational direction downstream end 48*b* of the inner cover 48 at a position satisfying these conditions, a range in which the peeling magnetic pole S3 is covered with the inner cover 48 can be broadened.

However, the rotational direction downstream end 48*b* of the inner cover 48 may preferably be in a position of the horizontal plane H passing through the center O of the developing sleeve 44 or be positioned in a side upstream of the position of the horizontal plane H with respect to the rotational direction R. This is because when the rotational direction downstream end 48*b* of the inner cover 48 is positioned in a side further downstream of this position, the developer peeled off the developing sleeve 44 is not readily taken in the developing chamber 41*a*. For this reason, in this embodiment, the rotational direction downstream end 48*b* of the inner cover 48 is positioned within the range of the half-width W of the magnetic flux density distribution of the peeling magnetic pole S3.

Specifically, the outer cover 47 is formed by being bent toward the photosensitive drum 1 so that the outer cover 47 covers the developing sleeve 44 from an upper end of a side wall 41g, provided as a part of the developing container 41 in a side opposite from the photosensitive drum 1 with respect to the developing sleeve 44, toward the photosensitive drum 1. Further, the outer cover 47 includes a first opposing portion 47*a* provided in the photosensitive drum 1 side, a second opposing portion 47*b* provided in the side wall 41*g* side, a continuous portion 47*c* connecting the first opposing portion 47*a* with the second opposing portion 47*b*, and a third opposing portion provided at a free end of the first opposing portion 47*a*.

The first opposing portion 47*a* opposes the developing sleeve 44 in a side upstream, with respect to the rotational direction R of the developing sleeve 44, of a part (the continuous portion 47*c*) opposing the rotational direction upstream end 48*a* of the inner cover 48. The second opposing portion 47*b* opposes an intermediary portion between the upstream end 48*a* and the downstream end 48*b* of the inner cover 48 with respect to the rotational direction R.

The second opposing portion 47*b* is disposed outside the first opposing portion 47*a* with respect to a radial direction of the developing sleeve 44 since the inner cover 48 is disposed between itself and the developing sleeve 44. For this reason, the continuous portion 47*c* connecting an upstream end of the second opposing portion 47*b* with respect to the rotational direction R with a downstream end of the first opposing portion 47*a* with respect to the rotational direction R is provided. The continuous portion 47*c* is formed so as to be bent from the upstream end of the second opposing portion 47 with respect to the rotational direction R toward the developing sleeve 44 side. Further, the continuous portion 47*c* opposes the rotational direction upstream end 48*a* of the inner cover 48 with a gap with respect to the rotational direction R.

The third opposing portion 47*d* is formed so as to be bent from the upstream end of the first opposing portion 47*a* with respect to the rotational direction R outward with respect to the radial direction of the developing sleeve 44 and opposes the surface of the photosensitive drum 1. The third opposing portion 47*d* opposes the photosensitive drum 1 with a gap therebetween in a predetermined range in a side downstream of the opposing region A with respect to the rotational direction R of the photosensitive drum 1. In the case of this embodiment, the third opposing portion 47*d* is formed in a length of 3 mm or more and 10 mm or less with respect to the rotational direction of the photosensitive drum 1. Further, a gap between the third opposing portion 47*d* and the photosensitive drum 1 was the same with respect to both the rotational direction of the photosensitive drum 1 and the longitudinal direction (rotational axis direction of the developing sleeve 44) of the photosensitive drum 1.

Next, the angles θ1 to θ6 will be described. The angle θ1 is an angle from the horizontal plane H to the opening 41*h* of the developing container 41. That is, the angle θ1 is an angle formed between the horizontal plane H and a line segment connecting the center O of the developing sleeve 44 and an upstream end of the first opposing portion 47*a* of the outer cover 47 with respect to the rotational direction R. The angle θ2 is an angle from the horizontal plane H to a downstream end of the first opposing portion 47*a* with respect to the rotational direction R. That is, the angle θ2 is an angle formed between the horizontal plane H and a line segment connecting the center O of the developing sleeve 44 and the downstream end of the first opposing portion 47*a* with respect to the rotational direction R. Accordingly, a range from an end of the angle θ1 to an end of the angle θ2 constitutes the first opposing portion 47*a*. The angle θ3 is an angle from the horizontal plane H to the rotational direction upstream end 48*a* of the inner cover 48. That is, the angle θ3 is an angle formed between the horizontal plane H and a line segment connecting the center O of the developing sleeve 44 and the upstream end 48*a*. The angle θ4 is an angle from the horizontal plane H to the rotational direction downstream end 48*b* of the inner cover 48. That is, the angle θ4 is an angle formed between the horizontal plane H and a line segment connecting the center O of the developing sleeve 44 and the downstream end 48*b*. Accordingly, a range from an end of the angle θ3 to an end of the angle θ4 constitutes the inner cover 48. The angle θ5 is an angle from the horizontal plane H to the photosensitive drum of the peeling magnetic pole S3. That is, the angle θ5 is an angle formed between the horizontal plane H and a line segment connecting the center O of the developing sleeve 44 and the peak position of the peeling magnetic pole S3. The angle θ6 is an angle from the horizontal plane H to a peak position of the feeding magnetic pole N2 disposed adjacently upstream of the peeling magnetic pole S3 with respect to the rotational direction R. That is, the angle θ6 is an angle formed between the horizontal plane H and a line segment connecting the center O of the developing sleeve 44 and the peak position of the feeding magnetic pole N2.

In the case of this embodiment, a relationship of θ1<θ6<θ2 is satisfied. That is, the first opposing portion 47*a* is formed so as to cover at least the peak position of the feeding magnetic pole N2. In this embodiment, the upstream end of the first opposing portion 47*a* with respect to the rotational direction R is positioned in the neighborhood of an upstream minimum of a pair of minimums, with respect to the rotational direction R, in terms of an absolute value of the magnetic flux density distribution of the feeding magnetic pole N2.

Further, a relationship of θ2<θ3 is satisfied, and in a range from an end of the angle θ2 to an end of the angle θ3, the gap where the above-described continuous portion 47*c* opposes the upstream end 48*a* of the inner cover 48. Further, a relationship of θ3<θ5<θ4 is satisfied. That is, the inner cover 48 is formed so as to cover at least the peak position of the peeling magnetic pole S3. Further, the angle θ3 is made larger than an angle (90°) formed between the perpendicular plane P and the horizontal plane H. The developing sleeve 44 has a cylindrical shape, and the perpendicular plane P passes through the top (upstream end position) of the developing sleeve 44. Accordingly, the upstream end 48*a* of the inner cover 48 is positioned in a side downstream of the top of the developing sleeve 44 with respect to the rotational direction R.

Here, a gap between the first opposing portion 47*a* and the developing sleeve 44 (i.e., a gap of a region from the end of the angle el to the end of the angle eθ2) is referred to as a first gap (first flow path) F1. A gap between the inner cover 48 and the developing sleeve 44 (i.e., a gap in a region from the end of the angle θ3 to the end of the angle θ4) is referred to as a second gap (second flow path) F2. A gap between the second opposing portion 47*b* and the inner cover 48 is referred to as a third gap (third flow path) F3.

Further, with respect to a cross-section (radial cross-section passing through a center axis of the developing sleeve 44) perpendicular to the rotational direction R of the developing sleeve 44, a minimum gap of the first gap F1 with respect to the rotational direction R is referred to as L1, and a minimum cross-sectional area is referred to as A1. Similarly, a minimum gap of the second gap F2 with respect to the rotational direction R is referred to as L2, a minimum cross-sectional area is referred to as A2, a minimum gap of the third gap F3 with respect to the rotational direction R is referred to as L3, and a minimum cross-sectional area is referred to as A3.

In this embodiment, the first opposing portion 47*a* is formed along a peripheral surface of the developing sleeve 44, and therefore, the gap and the cross-sectional area of the first gap F1 are substantially the same with respect to the rotational direction R. Also the inner cover 48 is formed along the peripheral surface of the developing sleeve 44, and therefore, the gap and the cross-sectional area of the second gap F2 are also substantially the same with respect to the rotational direction R. On the other hand, with respect to the rotational direction R, the gap and the cross-sectional area of the third gap F3 gradually increases from an upstream side toward a central side and gradually decreases from the central side toward a downstream side.

As described above, the continuous portion 47*c* connecting the second opposing portion 47*b* and the first opposing portion 47*a* is caused to oppose the rotational direction upstream end 48*a* of the inner cover 48 with the gap with respect to the rotational direction R. In this embodiment, between the continuous portion 47*c* and the upstream end 48*a* and with respect to the rotational direction R, a gap formed between the first gap F1 and the second gap F2 and formed between the first gap F1 and the third gap F3 (i.e., the gap in the region from the end of the angle θ2 to the end of the angle θ3) is referred to as a fourth gap (merging path) F4. That is, the fourth gap F4 is the gap such that the second gap F2 and the third gap F3 communicate with the first gap F1. Such a gap F4 is formed so that a gap L4 with respect to a cross-section perpendicular to the rotational direction R of the developing sleeve 44 becomes larger toward the downstream side of the rotational direction R.

Further, in a side downstream of the downstream end 48*b* of the inner cover 48 with respect to the rotational direction R, a fifth gap (branch path) F5 is provided. The fifth gap F5 is a gap provided downstream of the second gap F2 and the third gap F3 with respect to the rotational direction R and which is formed between the developing sleeve 44 and the outer cover 47 or the side wall 41*g*.

In this embodiment, the above-described minimum gaps L1, L2 and L3 and the above-described minimum cross-sectional areas A1, A2 and A3 are caused to satisfy the following relationships.

$A1 \leq A2+A3$ $A2 \leq A3$ $L1 \leq L2+L3$ $L2 \leq L3$

[Air Flow Around Developing Sleeve]

Figure 8:
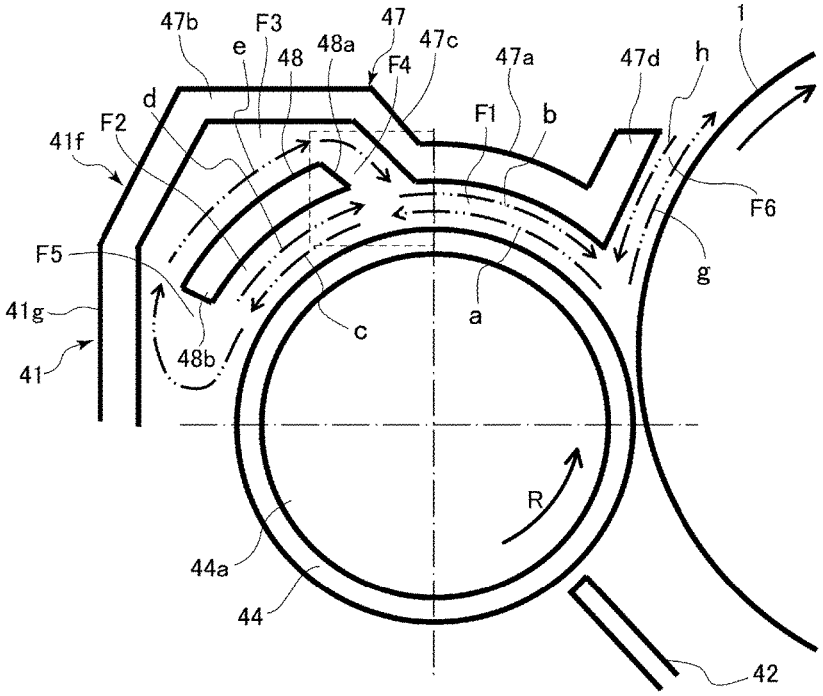
FIG. 8 is a sectional view schematically showing an air flow at a periphery of the developing sleeve of the developing device in the First Embodiment.
Figure 9:
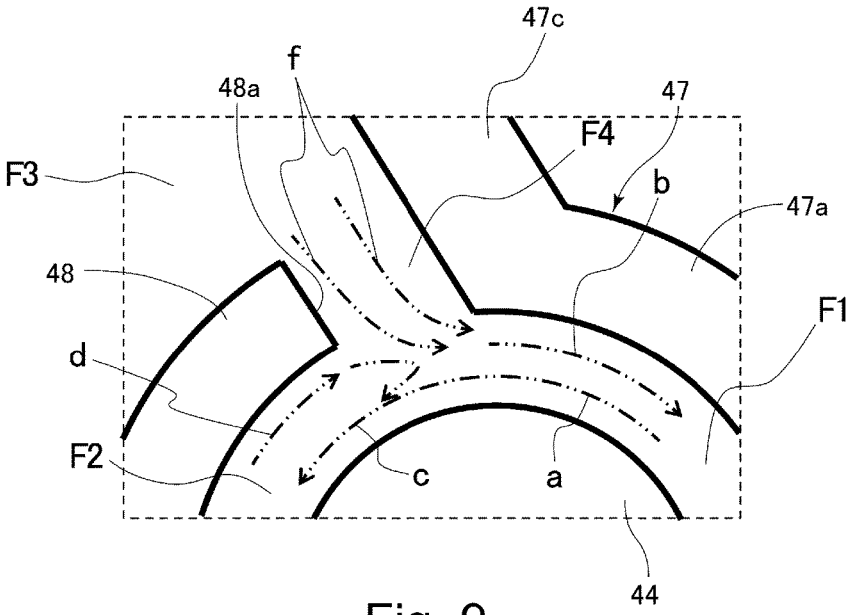
FIG. 9 is a sectional view schematically showing an air flow at a periphery of a merging path of the developing device in the First Embodiment.

Next, an air stream (air flow) around the developing sleeve 44 will be described using FIGS. 8 and 9. In this embodiment, as described above, by providing the first to fifth gaps F1 to F5 around the developing sleeve 44, the air stream as shown in FIG. 8 generates. First, in the neighborhood of the developing sleeve 44 in the first gap F1, an air stream a generates so as to be moved with rotation of the developing sleeve 44, so that the air flows into the developing container 41. By inflow of the air, an internal pressure of the developing container 41 increases, and an air stream b generates in the first opposing portion 47*a* side of the first gap F1 so that the internal pressure is maintained in an equilibrium state from an inside toward an outside of the developing container 41.

Further, in the neighborhood of the developing sleeve 4 in the second gap F2, an air stream c generates with movement of the magnetic chain at the peeling magnetic pole S3 (FIG. 7), and the air taken in the developing container 41 by the air stream c flows backward by air streams d and e. That is, the air stream c flowed to a side downstream of the second gap F2 with respect to the rotational direction R is branched in the fifth gap F5 and flows backward into the second gap F2 and the third gap F3, so that the air stream d generates in the inner cover 48 side of the second gap F2 and the air stream e generates in the third gap F3.

As described above, the toner is liberated in a large amount when the magnetic chain falls down by the peeling magnetic pole S3, and therefore, the thus generated liberated toner is contained in a large amount in the air stream d in the second gap F2. For this reason, in this embodiment, the downstream end 48*b* of the inner cover 48 is positioned downstream of the position of the upstream minimum M1 of the peeling magnetic pole S3 in the magnetic flux density distribution, so that at least a part of the peeling magnetic pole S3 is covered with the inner cover 48 (FIG. 7). Particularly, in this embodiment, the downstream end 48*b* of the inner cover 48 is positioned downstream of the peak position of the peeling magnetic pole S3 with respect to the rotational direction R, and therefore, when the magnetic chain falls down by the peeling magnetic pole S3, most of the region in which the liberated toner generates can be covered with the inner cover 48.

Further, the inner cover 48 is provided between the developing sleeve 44 and the outer cover 47, the second gap F2 is provided between the inner cover 48 and the developing sleeve 44, and the third gap F3 is provided between the inner cover 48 and the outer cover 47. Accordingly, the air stream e generated by the back-flow of the air stream c can be formed in the third gap F3. The third gap F3 is isolated from the second gap F2 by the inner cover 48, and therefore, the air stream e constitutes the air in which an amount of the toner liberated from the carrier as described above is small.

Further, the rotational direction upstream end 48*a* of the inner cover 48 opposes the continuous portion 47*c* of the outer cover 47 with the fourth gap F4 with respect to the rotational direction R. For this reason, the air stream e passing through the third gap F3 merges with the air stream b in the first gap F1 through the fourth gap F4. At this time, as shown in FIG. 9, the air stream f flowing through the fourth gap F4 as a merging path constitutes an air curtain, so that the air stream d in the second gap F2 is liable to be returned to the flow of the air stream c. As a result, the air stream d containing the liberated toner in the large amount is not readily discharged from the developing container 41, so that scattering of the developer can be suppressed.

Particularly, in this embodiment, the minimum cross-sectional area A1 of the first gap F1 is not more than the sum of the minimum cross-sectional area A2 of the second gap F2 and the minimum cross-sectional area A3 of the third gap F3 ($A1 \leq A2+A3$). In this embodiment, the first to fifth gaps F1 to F5 are formed substantially in the same shape with respect to the rotational axis direction of the developing sleeve 44. For this reason, the above-described relationship can also be represented by a relationship such that the minimum gap (length) L1 of the first gap F1 is not more than the sum of the minimum gap (length) L2 of the second gap F2 and the minimum gap (length) L3 of the third gap F3 ($L1 \leq L2+L3$). Incidentally, even if each of shapes of the respective gaps are different with respect to the rotational axis direction of the developing sleeve 44, when an average of gaps at an associated position with respect to the radial direction of the developing sleeve 44 is minimum with respect to the rotational direction R, the average of the gaps at the position may be employed as a minimum gap (length).

In either case, by satisfying the above-described condition, an area in which the upstream end 48*a* of the inner cover 48 and the continuous portion 47*c* oppose each other can be ensured, so that an effect of the air curtain by the air stream f can be enhanced. Incidentally, in order to enhance the effect of the air curtain, it is preferable that A1<A2+A3 (L1<L2+L3) is satisfied. However, even when A1=A2+A3 (L1=L2+L3) holds, A1<A2+A3+(cross-sectional area of inner cover 48) or L1 (L2+L3+(thickness of inner cover 48) is satisfied, and therefore, the area in which a part of the inner cover 48 and the continuous portion 47*c* oppose each other can be ensured.

Here, a portion, of the inner cover 48, opposing the continuous portion 47*c* which is a part of the outer cover 48 is not limited to the upstream end 48*a*. For example, even when the upstream end of the inner cover 48 with respect to the inner cover 48 is in a position (for example, a position inside the part of the outer cover 47 with respect to the radial direction) which does not oppose the part of the outer cover 47, a downstream part of the upstream end, with respect to the rotational direction R, of the inner cover 48 may only be required to oppose the part of the outer cover 47. However, in this case, there is a possibility that the minimum gap (length) of the second gap F2 between the inner cover 48 and the developing sleeve 44 becomes smaller than the gap (length) of the first gap F1. In the case where the feeding of the magnetic chain by the developing sleeve 44 is taken into consideration, presence of a portion where the gap (length) of the second gap F2 is extremely small is not preferable. For this reason, it is preferable that a constitution in which the upstream end 48*a* of the inner cover 48 is caused to oppose the part of the outer cover 47 is employed.

Further, in this embodiment, the minimum cross-sectional area A2 of the second gap F2 is made not more than the minimum cross-sectional area A3 of the third gap F2 (A2≤A3). As a result, pressure loss of the flow path in the third gap F2 is made smaller than pressure loss of the flow path in the third gap F2. Further, a flow rate of the air stream e passing through the third gap F3 is increased, and a flow rate of the air stream d passing through the second gap F2 is decreased. As a result, not only the above-described effect of the air curtain can be easily obtained but also the air stream e which is the air in which the amount of the liberated toner is small can be passed through a discharge path in a larger amount than the air stream d which is the air in which the amount of the liberated toner is large, so that scattering of the developer from the developing container 41 can be suppressed.

Incidentally, in order to make the pressure loss of the flow path in the third gap F2 smaller than the pressure loss of the flow path in the second gap F2, A2<A3 may preferably be satisfied. However, even when A2=A3 holds, in the second gap F2, the air stream c opposing the air stream d exists with the rotation of the developing sleeve 44, and therefore, the pressure loss of the flow path in the second gap F2 becomes larger than the pressure loss of the flow path in the third gap F3.

In order to satisfy such a relationship, the minimum gap (length) L2 of the second gap F2 may also be made not more than the minimum gap (L) L3 of the third gap F2 (L2≤L3). The reason therefor is the same as that described in the case of A2<A3. Further, also in this case, L2<L3 may preferably be satisfied, but similarly as described above, due to the presence of the air stream c, L2=L2 may also be employed.

However, when the minimum cross-sectional area A3 or the minimum gap L3 is made excessively small, there is a liability that a flow of the air stream c for taking the scattering toner in the developing container 41 is hindered and the flow rate of the air stream e extremely lowers. For this reason, the minimum gap L2 may preferably be set at 1.5 mm-3.0 mm, and the minimum gap L3 may preferably be set at 2.0 mm-3.5 mm.

Further, in the case of this embodiment, the fourth gap F4 is disposed so as not to overlap with the peak position (end of the angle θ6) of the feeding magnetic pole N2. That is, the fourth gap F4 is formed at a position deviated from the peak position of the feeding magnetic pole N2 in the rotational direction R, and in this embodiment, is disposed downstream of the peak position with respect to the rotational direction R. This is because when the fourth gap F4 and the peak position of the feeding magnetic pole N2 overlap with each other, the scattering toner generating when the magnetic chain of the feeding magnetic pole N2 starts to fall down is diffused by the air stream f and thus the effect of the air curtain is lowered.

Further, in this embodiment, the upstream end 48*a* of the inner cover 48 is positioned downstream of a position vertically above the top (point) of the developing sleeve 44 with respect to the rotational direction R. In other words, the upstream end 48*a* of the inner cover 48 is positioned inside the developing container 41 more than the perpendicular plane P passing through the developing sleeve 44 is. The toner is liable to deposit on the upper surface of the inner cover 48 and on the upstream end 48*a*. For this reason, there is a liability that the toner deposited thereon falls from the upstream end 48*a* due to some factor. Here, in the case where the deposited toner falls in a side upstream of the top of the developing sleeve 44 with respect to the rotational direction R, there is a liability that the dropped toner is deposited on the photosensitive drum 1 and has the influence on an image formed on the photosensitive drum 1.

On the other hand, in this embodiment, the upstream end 48*a* of the inner cover 48 is positioned downstream of the top of the developing sleeve 44 with respect to the rotational direction R, and therefore, the toner deposited on the inner cover 48 falls from the upstream end 48*a* toward a side downstream of the top of the developing sleeve 44 with respect to the rotational direction R. Accordingly, the dropped toner is taken inside the developing container 41 with the rotation of the developing sleeve 44, so that the influence of the dropped toner on the image formed on the photosensitive drum 1 can be suppressed.

Further, in the case of this embodiment, at a free end portion of the cover 47 on the photosensitive drum 1 side, the third opposing portion 47*d* opposing the photosensitive drum 1 is provided in a predetermined range with respect to the rotational direction. Further, between the third opposing portion 47*d* and the photosensitive drum 1, a sixth gap (sixth flow path) F6 is formed along the rotational direction of the photosensitive drum 1. As shown in FIG. 8, in the sixth gap F6, an air stream g generates with rotation of the photosensitive drum 1. The air stream g is a flow in a direction in which the air is discharged from the sixth gap F6. On the other hand, in the sixth gap F6, in order to make in flow and out flow of the air in the sixth gap F6 equivalent, an air stream h flows from outside air in a direction opposite to the direction of the air stream g. The air stream h is rectified by the third opposing portion 47*d* and flows into the developing container 41.

In the case where the third opposing portion 47*d* is not provided, the air stream h can cause turbulent flow in the neighborhood of a merging portion with the air stream b in the first gap F1. When the turbulent flow generates in the neighborhood of the merging portion between the air stream h and the air stream b, the magnetic chain of the developer formed on the developing sleeve 44 is disturbed and the toner can be liberated. Then, the liberated toner is caught in the air stream b and the air stream g, so that the amount of the liberated toner contained in these air streams b and g can increase. There is a limit to an amount of the liberated toner contained in the air stream b and caught by the magnetic chain, and there is a limit to a deposition amount, on the photosensitive drum 1, of the liberated toner contained in the air stream g. Therefore, the developer is liable to scatter to the outside of the developing container 41 by the air streams b and h.

In view of this point, in this embodiment, the third opposing portion 47*d* is provided and the air stream h is rectified by the third opposing portion 47*d*, so that the scattering of the developer to the outside of the developing container 41 is suppressed. That is, the air stream h is rectified and thus the turbulent flow does not readily generate in the neighborhood of the merging portion between the air streams h and b, so that the amount of the liberated toner contained in the air streams b and g does not readily increase. Further, the rectified air stream h forms an air curtain in the neighborhood of the merging portion between the air streams h and b. In the case where the air curtain is formed in the neighborhood of the merging portion between the air streams h and b, the air stream b is liable to merge with the air stream a in a manner such that the air stream b is returned to the first gap F1. In other words, a part of the air stream can be circulated in the developing container 41. The air stream b is merged with the air stream a, so that the air stream b is not readily discharged to the outside of the developing container 41. Further, a part of the air stream b which is not circulated is merged with the air stream h, so that the liberated toner contained in the air stream b is liable to be caught by the magnetic chain formed on the developing sleeve 44 in the neighborhood of the opposing region A. Further, as regards the air stream g in the neighborhood of the photosensitive drum 1, the liberated toner is deposited little by little on the photosensitive drum 1, and therefore, the liberated toner contained in the air stream g does not readily leak to the outside.

As described above, according to the constitution of this embodiment, the developer scattering can be sufficiently suppressed. Further, even if the developer is scattered, a scattering amount is small, and therefore, even when the developer is deposited on the image, a deposition amount is to the extent such that the deposited toner cannot be visually recognized, so that a lowering in image quality can be suppressed.

[Comparison Experiment]

In order to confirm an effect of this embodiment, an experiment in which the toner scattering amount was compared between a constitution of a comparison example and the constitution of this embodiment will be described. First, an outline of a toner scattering amount measuring method employed in this experiment will be described with reference to FIG. 7. Incidentally, an apparatus used in the experiment is prepared by assembling the photosensitive drum, the developing device and other constituent members, excluding the exposure device, disposed at the periphery of the photosensitive drum into a unit. In the experiment, similarly as during normal image formation, in a state in which the rotation of the photosensitive drum, the drive of the charging device and the developing device and the bias application are carried out, the toner scattering amount was measured in the following manner.

In a region excluding both longitudinal ends of the developing device 4, the toner in the developing device 4 passes through the sixth gap F6 between the photosensitive drum 1 and the third opposing portion 47*d*, of the outer cover 47, opposing the photosensitive drum 1 and is scattered to the outside of the developing device 4. Therefore, a substantially central portion of the sixth gap F6 with respect to the longitudinal direction longitudinal direction (rotational axis direction of the developing sleeve 44) is irradiated with line laser beam (light) so as to be perpendicular to the developing sleeve 44 and the photosensitive member 1. The line laser beam is a laser beam (light) which is emitted in a line shape with a certain line width and which forms a sector-shaped two-dimensional plane optical path. The line laser beam is usually prepared by scattering a dot laser beam in a certain direction by a cylindrical lens or a rod lens. The scattering toner flying on the optical path of the line laser beam scatters the laser light (beam). For that reason, from a direction substantially perpendicular to an irradiation direction of the line laser beam, a laser irradiation range is observed through a high-speed camera or the like, whereby it is possible to measure the number of particles and a locus of the scattering toner present in the laser irradiation range.

As regards the line laser beam, a YAG laser ("DPGL-5W", manufactured by Japan Laser Corp.) was used as a light source. Further, an optical system using a cylindrical lens (attached to the product) was adjusted so that a line width was 0.5 mm in the sixth gap F6 and then an object was irradiated with the line laser beam. For observation, a high-speed camera ("SA-3", manufactured by PHOTORON Ltd.) was used. Further, in order to permit observation of the scattering toner on the line laser beam, a shooting condition (frame rate and exposure time) and the optical system (such as the lens) of the high-speed camera were selected.

The number of scattering (scattered) toner particles, obtained by the above-described method, passing through the substantially longitudinal central portion of the sixth gap F6 was converted into a scattering toner (particle) number corresponding to that per A4-sized sheet (210 mm×297 mm). Incidentally, the experimental apparatus (device) was constituted as described above, and therefore, in this conversion, contribution of image region end portions, contribution of the toner supply and the influence of the air flow in the image forming apparatus on the toner scattering are not taken into consideration.

Figure 6:
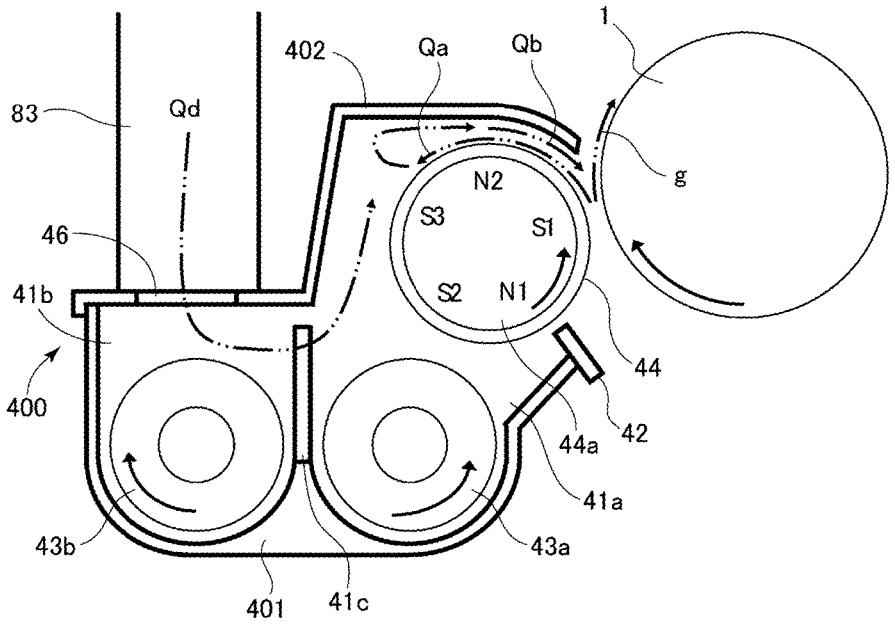
FIG. 6 is a sectional view schematically showing an air flow of a developing device in a comparison example.

In the comparison experiment, experimental apparatuses (devices) having a constitution (First Embodiment, Embodiment 1) of L2≤L3 similar to that of this embodiment, a constitution (Comparison Example 1) shown in FIG. 6, and a constitution (Comparison Example 2) of L2<L3 different from that of this embodiment were prepared and were subjected to the experiment under the above-described condition. In Embodiment 1, L2=2 mm and L3=2.5 mm were set, and in Comparison Example 2, L2=2.5 mm and L3=2 mm were set. In Comparison Example 1, no cover is provided, but the distance between the developing sleeve and the upper cover 402 was set at 2.5 mm. Further, in Comparison Example 1, the third opposing portion 47*d* was not provided, but a portion of the upper cover 402 opposing the photosensitive drum 1 was irradiated with the laser beam at a substantially longitudinal central portion thereof. Other constitutions are common to this embodiment (Embodiment 1) and Comparison Examples 1 and 2.

Figure 10:
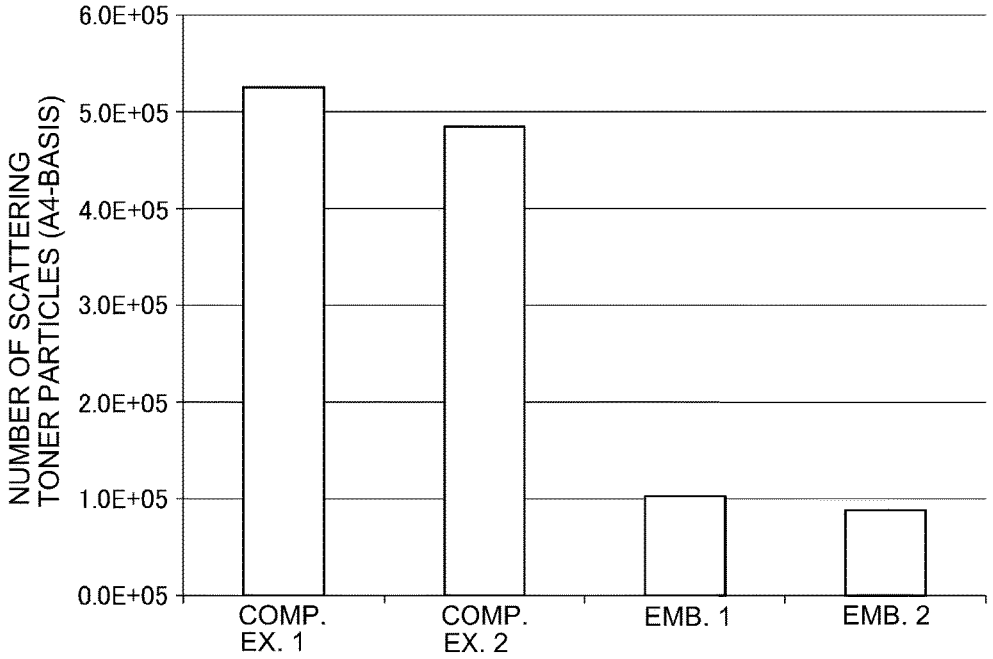
FIG. 10 is a graph showing a result of a comparative experiment.

A result of this experiment is shown in FIG. 10. First, in the case where Comparison Examples 1 and 2 are compared with each other, the scattering toner (particle) number in Comparison Example 2 was smaller than the scattering toner number in Comparison Example 1. However, compared with Comparison Example 1, the scattering toner number could not be reduced in a large amount. This is predicted because although the air stream e generates in the third gap F3, also the air stream d generates due to the relationship in pressure loss between the second gap F2 and the third gap F3 and thus an amount in which the air stream d directly carries the liberated toner, generated in the neighborhood of the S3 pole, to the air stream g is large.

Next, in the case where Comparison Example 1 and Embodiment 1 were compared with each other, the scattering toner number in Embodiment 1 was made considerably smaller than the scattering toner number in Comparison Example 1. This is predicted because due to the relationship in pressure loss between the second gap F2 and the third gap F3, the air stream e is larger in amount than the air stream d, and thus the number of the scattering toner (particles) contained in the air stream g is relatively decreased. From the above, in Embodiment 1 (the constitution of this embodiment), compared with Comparison Examples 1 and 2, a degree of the toner scattering could be largely decreased.

<Second Embodiment>

Figure 11:
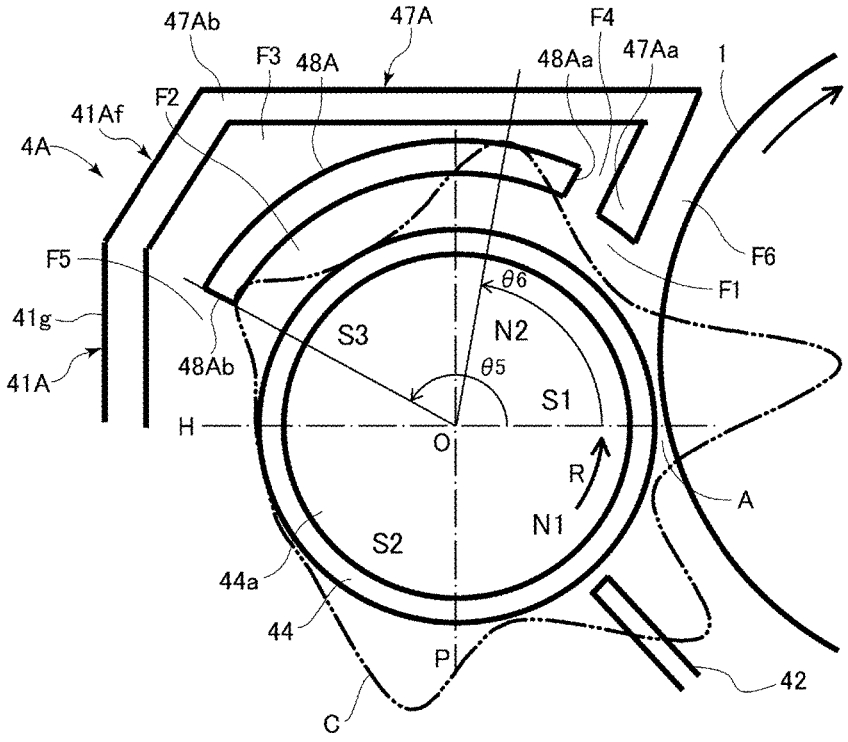
FIG. 11 is a sectional view of a periphery of a developing sleeve of a developing device according to a Second Embodiment.

The Second Embodiment (Embodiment 2) will be described using FIG. 11. Meanings of the respective lines in FIG. 11 are similar to those in FIG. 7. In the First Embodiment, the upstream end 48*a* of the inner cover 48 was positioned downstream of the top of the developing sleeve 44 with respect to the rotational direction R. On the other hand, in the case of a developing device 4A in this embodiment, an upstream end 48Aa of an inner cover 48A is positioned upstream of the top of the developing sleeve 44 with respect to the rotational direction R. Constitutions other than the constitution of a developing container 41A of the developing device 4A are similar to those in the above-described First Embodiment. Constituent elements similar to those in the First Embodiment (Embodiment 1) are represented by the same reference numerals or symbols and will be omitted from description or briefly described. In the following, a portion different from the First Embodiment will be principally described.

The developing container 41A includes an upper cover 41Af for covering the developing sleeve 44 on a side downstream of the opposing region A with respect to the rotational direction R of the developing sleeve 44. The upper cover 41Af includes an outer cover 47A as a first covering portion and an inner cover 48A as a second covering portion. The outer cover 47A is disposed downstream of the opposing region A with respect to the rotational direction R and covers the developing sleeve 44 with a gap. The inner cover 48A is disposed between the outer cover 47A and the developing sleeve 44 so as to provide a gap between itself and the outer cover 47A and a gap between itself and the developing sleeve 44 and covers the developing sleeve 44.

The outer cover 47A includes a first opposing portion 47Aa provided in the photosensitive drum 1 side, and a second opposing portion 47Ab provided in the side wall 41*g* side. The first opposing portion 47Aa opposes the developing sleeve 44 in a side upstream, with respect to the rotational direction R of the developing sleeve 44, of a part opposing the rotational direction upstream end 48Aa of the inner cover 48A. The second opposing portion 47Ab opposes an intermediary portion between the upstream end 48Aa and the downstream end 48Ab of the inner cover 48A with respect to the rotational direction R.

In the case of this embodiment, the first opposing portion 47Aa is formed by being bent from an end portion of the second opposing portion 47Ab on the photosensitive drum 1 side toward the developing device 44 side, and a free end thereof is caused to oppose the developing sleeve 44 with a first gap F1. Further, a side surface of the first opposing portion 47Aa opposes the photosensitive drum 1 with a sixth gap F6 in a predetermined range along a rotational direction of the photosensitive drum 1.

The upstream end 48Aa of the inner cover 48 is positioned upstream of the top of the developing sleeve 44 with respect to the rotational direction R, and in this embodiment, is positioned upstream of the peak position (end of the angle θ6) of the feeding magnetic pole N2. On the other hand, the downstream end 48Ab of the inner cover 48 is in a substantially overlapping position with the peak position (end of the angle θ5) of the peeling magnetic pole S3. The position of the downstream end 48Ab may also be the same as that in the First Embodiment. In such a case of this embodiment, the inner cover 48A covers the feeding magnetic pole N2 over the peak position, and therefore, a degree of scattering of the toner liberated at the feeding magnetic pole N2 can also be reduced. Other requirements of the respective constitutions are similar to those in the First Embodiment.

Incidentally, also in this embodiment, a comparison experiment was conducted similarly as in the above-described First Embodiment. A result thereof is shown in FIG. 10 described above. In Embodiment 2 having the same constitution as that of this embodiment shown in FIG. 11, compared with Embodiment 1 (First Embodiment), the number of the scattering toner (particles) was small. This is predicted because in the same mechanism as that in Embodiment 1, also the air stream containing the liberated toner generating at the feeding magnetic pole N2 is discharged while detouring around the third gap F3, and therefore, the scattering toner contained in the air stream g (for example FIG. 8) is relatively decreased.

<Third Embodiment>

The Third Embodiment will be described using FIGS. 12 and 13. In the above-described First Embodiment, the gap between the photosensitive drum 1 and the third opposing portion 47*d* of the outer cover 47 was the same with respect to the longitudinal direction (rotational axis direction of the developing sleeve 44). On the other hand, in the case of a developing device 4B in this embodiment, a gap between the photosensitive drum 1 and a third opposing portion 47Bd of an outer cover 47B is smaller in longitudinal end regions than in a longitudinal central region (first region). Constitutions other than the constitution of a developing container 41B of the developing device 4B are similar to those in the above-described First Embodiment. Constituent elements similar to those in the First Embodiment are represented by the same reference numerals or symbols and will be omitted from description or briefly described. In the following, a portion different from the First Embodiment will be principally described.

Figure 12:
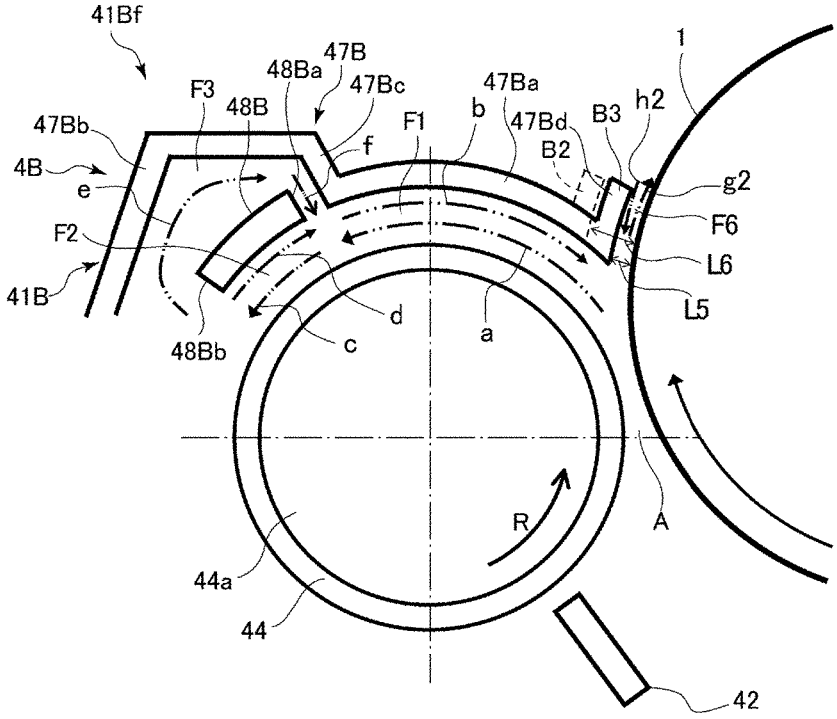
FIG. 12 is a sectional view of a periphery of a developing sleeve of a developing device according to a Third Embodiment.

As shown in FIG. 12, the developing container 41B includes an upper cover 41Bf for covering the developing sleeve 44 on a side downstream of the opposing region A with respect to the rotational direction R of the developing sleeve 44. The upper cover 41Bf includes an outer cover 47B as a first covering portion and an inner cover 48B as a second covering portion. The outer cover 47B is disposed downstream of the opposing region A with respect to the rotational direction R and covers the developing sleeve 44 with a gap. The inner cover 48B is disposed between the outer cover 47B and the developing sleeve 44 so as to provide a gap between itself and the outer cover 47B and a gap between itself and the developing sleeve 44 and covers the developing sleeve 44.

The outer cover 47B includes a first opposing portion 47Ba provided in the photosensitive drum 1 side, a second opposing portion 47Bb, a continuous portion 47Bc connecting the first opposing portion 47Ba and the second opposing portion 47Bb, and a third opposing portion 47Bd provided at a free end of the first opposing portion 47Ba. The first opposing portion 47Ba opposes the developing sleeve 44 in a side upstream, with respect to the rotational direction R of the developing sleeve 44, of a part (the continuous portion 47Bc) opposing the rotational direction upstream end 48Ba of the inner cover 48B. The second opposing portion 47Bb opposes an intermediary portion between the upstream end 48Ba and the downstream end 48Bb of the inner cover 48B with respect to the rotational direction R.

The third opposing portion 47Bd is formed by being bent from an upstream end of the first opposing portion 47Ba with respect to the rotational direction R outwardly in a radial direction of the developing sleeve 44, and opposes the surface of the photosensitive drum 1. Further, the third opposing portion 47Bd opposes the photosensitive drum 1 in a predetermined range along the rotational direction of the photosensitive drum 1 as described above.

Here, in the neighborhood of the photosensitive drum 1 and the developing sleeve 44 with respect to the longitudinal direction, even when the toner in a small amount is liberated from the carrier, the toner is deposited on the photosensitive drum 1 to the extent that the toner is not visually recognized on the image. On the other hand, at image formable region end portions, which are longitudinal end portions of the photosensitive drum 1 and the developing sleeve 44, and on outsides thereof, a force of toner deposition on the developing sleeve 44 is weak, and therefore, there is a possibility of the toner scattering to the outsides. Therefore, in this embodiment, the degree of the toner scattering in the neighborhood of the image formable region end portions is reduced.

Figure 13:
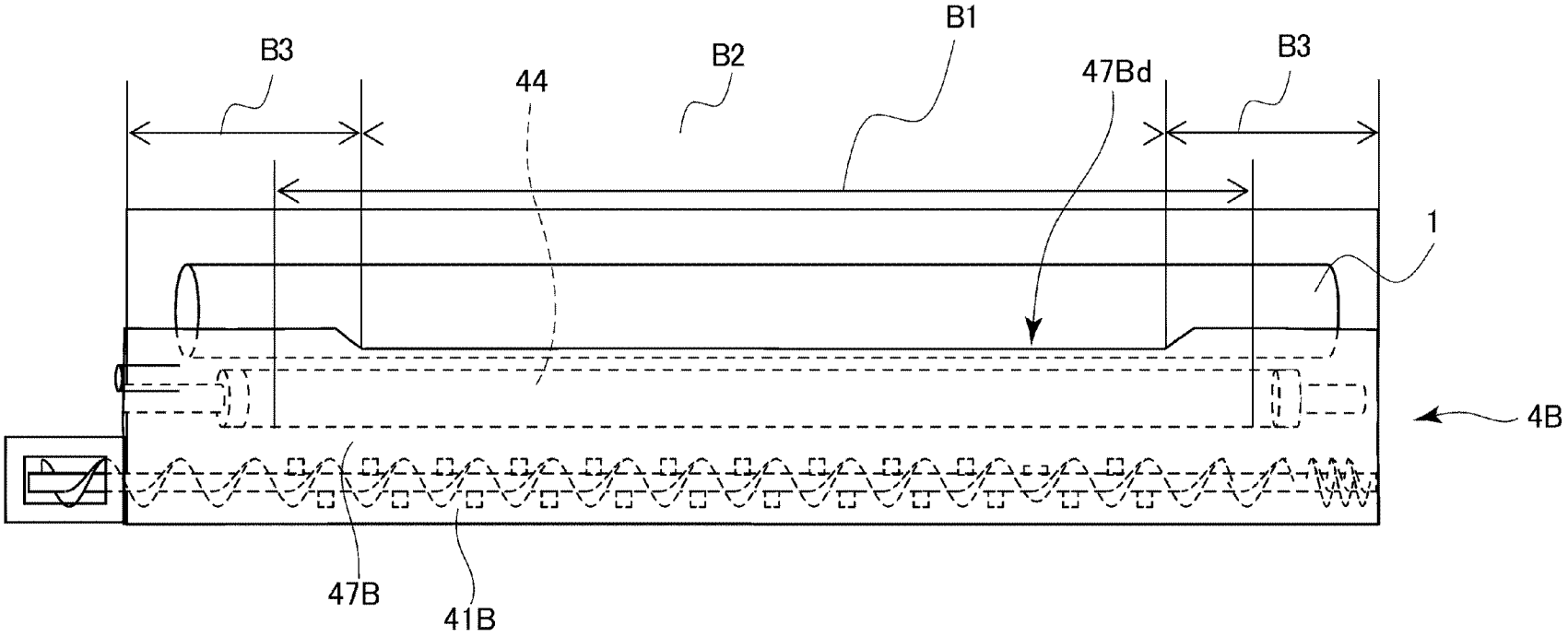
FIG. 13 is a longitudinal sectional view of a developing device according to the Third Embodiment.

As shown in FIG. 13, an image formable region (developer carrying region subjected to a surface roughening process so as to permit carrying of the developer) of the developing sleeve 44 is referred to as B1. Further, of the third opposing portion 47Bd, a region having a longitudinal length which is not less than ½ of a longitudinal length of the image formable region B1 when a longitudinal center of the image formable region B1 is taken as a center of the region is referred to as a central region B2. Further, of the third opposing portion 47Bd, each of regions outside longitudinal ends of the central region B2 is referred to as an end region B3. The end regions B3 are positioned on both end portion sides of the developing sleeve 44 while including a part of the image formable region B1.

Figure 14:
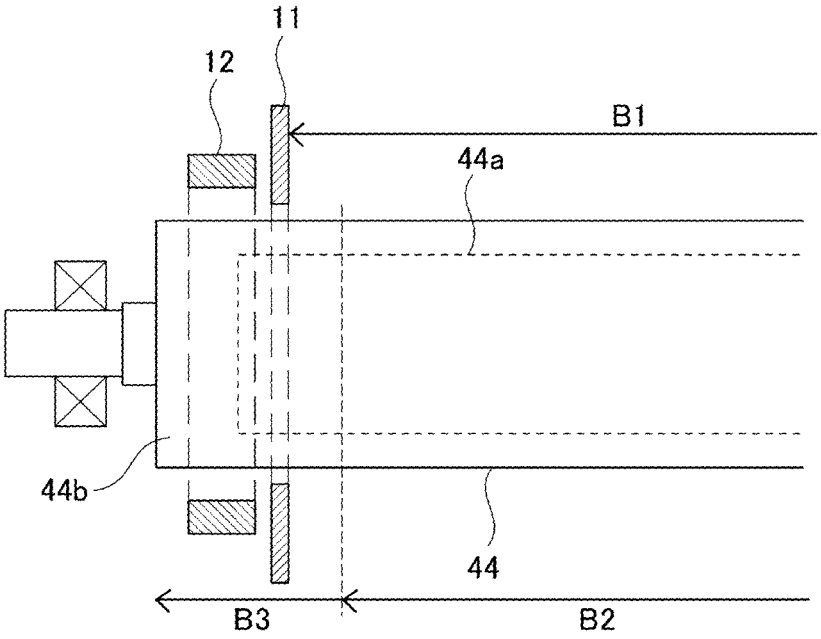
FIG. 14 is a longitudinal sectional view showing a developing sleeve end portion and a magnetic seal structure.

The central region B2 and the end regions B3 will be described using a specific example. Both end portions of the developing sleeve 44 are sealed. As a sealing constitution for sealing the both end portions of the developing sleeve 44, a magnetic sealing constitution for magnetically blocking between the outside and the inside of the developing container 41 (FIG. 2) is used. FIG. 14 shows an example of the magnetic sealing constitution. The magnetic sealing constitution shown in FIG. 14 is such that a magnetic plate 11 and a magnet sheet 12 are provided at an end portion 44*b* of the developing sleeve 44 which has not been subjected to the surface roughening process, i.e., outside the image formable region B1 (developer carrying region) with respect to the rotational axis direction of the developing sleeve 44.

The magnetic plate 11 is capable of forming the magnetic chain while covering the developing sleeve 44 in a non-contact manner in the form along an outer periphery of the developing sleeve 44. That is, a magnetic force generates between the magnetic plate 11 and the magnet 44*a* of the developing sleeve 44, so that the developer entering between the magnetic plate 11 and the developing sleeve 44 forms the magnetic chain. This magnetic chain blocks (closes) a gap between the magnetic plate 11 and the developing sleeve 44, and prevents leakage of the developer from the sleeve end portion 44*b*. Further, the magnet sheet 12 is provided outside the magnetic plate 11 with respect to the rotational axis direction of the developing sleeve 44. The magnet sheet 12 holds, by the magnetic force, the developer leaked through between the magnetic plate 11 and the developing sleeve 44. Thus, by providing the magnetic plate 11 and the magnet sheet 12, the developer leakage from the sleeve end portion 44*b* is suppressed.

The central region B2 is formed so that each of both ends thereof is in a position spaced therefrom, e.g., a position of the magnetic plate 11 toward a central side by 10 mm or more and 30 mm or less. Thus, the end regions B3 are capable of covering the both end portions of the image formable region B1. In this embodiment, a longitudinal length of the central region B2 was 290 mm-310 mm, and a longitudinal length of each of the end regions B3 was 20 mm-40 mm.

In such a case, the end regions B3 of the third opposing portion 47Bb are caused to approach the photosensitive drum 1 more than the central region B2 is. That is, in the case where a gap (distance) between the end region B3 and the photosensitive drum 1 is L5 and a gap (distance) between the central region B2 and the photosensitive drum 1 is L6, the third opposing portion 47Bd is formed so as to satisfy L5<L6. As an example, in each of the end region B3, the gap L5 is 2 mm-4 mm, and in the central region B2, the gap L6 is 4 mm-8 mm.

As a result, an amount of in flow and out flow of air streams g and h in the central region B2 in the sixth gap F6 is larger than an amount of in flow and out flow of air streams g2 and h2 in each of the end regions B3. For this reason, the degree of the toner scattering in the end regions B3 is reduced, so that an image defect due to the toner scattering in the image forming apparatus and contamination of the inside of the image forming apparatus with the scattered toner can be reduced. Other requirements of the respective constitutions are similar to those of the First Embodiment.

<Fourth Embodiment>

Figure 15:
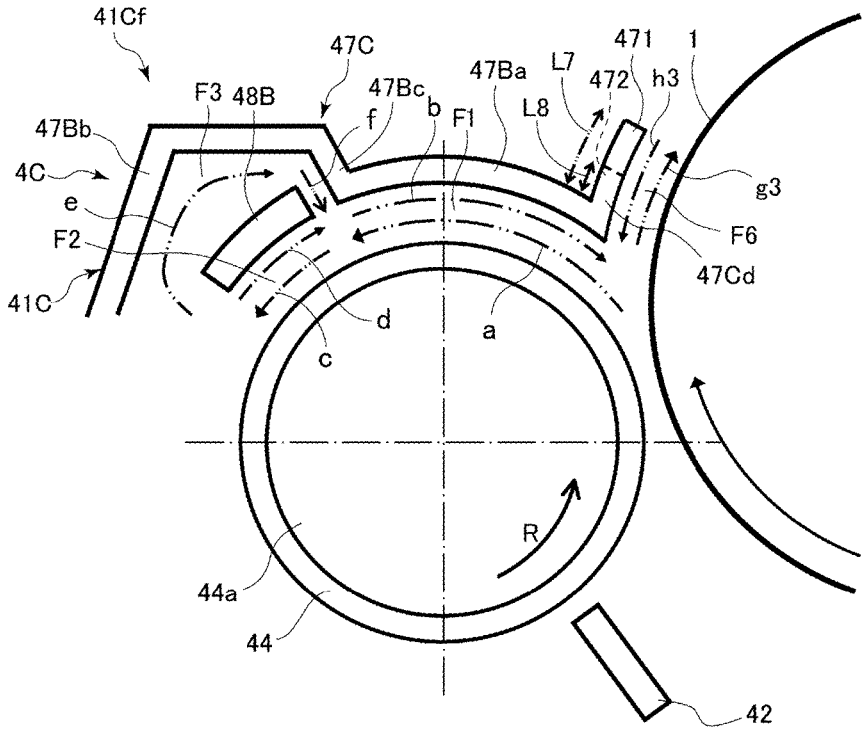
FIG. 15 is a sectional view of a periphery of a developing sleeve of a developing device according to a Fourth Embodiment.

The Fourth Embodiment will be described using FIG. 15. In the above-described Third Embodiment, the gap between the photosensitive drum 1 and the third opposing portion 47Bd of the outer cover 47B was made smaller in the longitudinal end regions than in the longitudinal central region. On the other hand, in the case of a developing device 4C in this embodiment, a length, with respect to the rotational direction of the photosensitive drum 1, of a third opposing portion 47Cd of an outer cover 47C is larger in the longitudinal end regions than in the longitudinal central region. Constitutions other than the constitution of the third cover portion 47Cd are similar to those in the above-described Third Embodiment. Constituent elements similar to those in the Third Embodiment are represented by the same reference numerals or symbols and will be omitted from description or briefly described. In the following, a portion different from the Third Embodiment will be principally described.

The developing container 41C includes an upper cover 41Cf for covering the developing sleeve 44 on a side downstream of the opposing region A with respect to the rotational direction R of the developing sleeve 44. The upper cover 41Cf includes an outer cover 47C as a first covering portion and an inner cover 48B as a second covering portion.

The outer cover 47C includes the third opposing portion 47Cd provided at a free end of the first opposing portion 47Ba. The third opposing portion 47Cd is formed by being bent from an upstream end of the first opposing portion 47Ba with respect to the rotational direction R outwardly in a radial direction of the developing sleeve 44, and opposes the surface of the photosensitive drum 1.

In the case of this embodiment, portions (regions), of the third opposing portion 47Cd, corresponding to the end regions B3 (FIG. 12) are referred to as first regions 471, and a portion (region) of the third opposing portion 47Cd, corresponding to the central region B2 (FIG. 12) is referred to as a second region 472. Further, a length of each of the first regions 471 with respect to the rotational direction of the photosensitive drum 1 is made longer than a length of the second region 472 with respect to the rotational direction of the photosensitive drum 1. That is, in the case where a length of the first region 471 is L7 and a length of the second region 472 is L8, the third opposing portion 47Cd is formed so as to satisfy L7<L8. As an example, the length L8 in the second region 472 is 3 mm-6 mm, and the length L7 in the first region 471 is 7 mm-10 mm.

As a result, an amount of in flow and out flow of air streams g and h in the second region 472 in the sixth gap F6 is larger than an amount of in flow and out flow of air streams g2 and h2 in each of the first regions 471. For this reason, the degree of the toner scattering in the first regions 471 is reduced, so that an image defect due to the toner scattering in the image forming apparatus and contamination of the inside of the image forming apparatus with the scattered toner can be reduced. Other requirements of the respective constitutions are similar to those of the First Embodiment.

<Other Embodiments>

In the above-described embodiments, as the constitution of the developing devices, the constitution using the two-component developer containing the toner and the carrier were described. However, even in the case of using a one-component developer containing toner having a magnetic property, the present invention is applicable even when a constitution including the above-described peeling magnetic pole is employed. Further, the constitutions of the above-described embodiments can be carried out by being appropriately combined with each other. For example, the constitutions of the Third and Fourth Embodiments may also be combined with each other. That is, the length of the end region B3 of the third opposing portion 47Bd in the Third Embodiment with respect to the rotational direction of the photosensitive drum 1 may also be made larger than the length of the central region B2 with respect to the rotational direction of the photosensitive drum 1. Further, the above-described Third and Fourth Embodiments may be combined with each other, or the Third Embodiment or Fourth Embodiment may also be combined with the Second Embodiment.

Further, the present invention is also applicable to, other than the constitution in which in the developing chamber, the supply of the developer to the developing sleeve and collection of the developer from the developing sleeve are carried out as described above. For example, with reference to FIG. 3, even a constitution such that the developer is supplied from the developing chamber 41*a* to the developing sleeve 44 and the developer peeled off the developing device 44 is collected by the stirring chamber 41*b* is employed, the present invention is applicable thereto.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2017-068774 filed on Mar. 30, 2017 and 2017-068777 filed on Mar. 30, 2017, which are hereby incorporated by reference herein in their entirety.

What is claimed is:

1. A developing device comprising:

a rotatable developing member configured to carry a developer containing toner and a carrier to a developing position where an electrostatic latent image formed on an image bearing member is developed;

a first frame configured to accommodate the developer;

a second frame mounted on said first frame and configured to cover part of an outer peripheral surface of said rotatable developing member;

a regulating portion provided opposite to said rotatable developing member and configured to regulate, at a position closest to said rotatable developing member, an amount of the developer carried on said rotatable developing member, said regulating portion being positioned below a rotation center of said rotatable developing member in a state that said developing device is in a position where the electrostatic latent image formed on the image bearing member is developed;

a magnet provided fixedly inside said rotatable developing member and configured to generate a magnetic field for peeling off the developer, passed through the developing position, from an outer peripheral surface of said rotatable developing member, said magnet including a plurality of magnetic poles including a first magnetic pole and a second magnetic pole which is provided adjacently to said first magnetic pole on a side downstream, with respect to a rotational direction of said rotatable developing member, of a first peak position where magnetic flux density of said first magnetic pole is a maximum and which has the same polarity as said first magnetic pole;

a cover portion provided opposite to said rotatable developing member along the outer peripheral surface of said rotatable developing member and provided between said second frame and said rotatable developing member over a rotational axis direction of said rotatable developing member, said cover portion being disposed so as to form a clearance between itself and said rotatable developing member with respect to a radial direction of said rotatable developing member and to form a clearance between itself and said second frame with respect to the radial direction of said rotatable developing member, wherein as seen in a cross section perpendicular to the rotational axial direction of said rotatable developing member in a state that said developing device is in the position where the electrostatic latent image formed on the image bearing member is developed, with respect to the rotational direction of said rotatable developing member, a most upstream end of said cover portion is positioned downstream of the developing position and upstream of a most upstream position of a half-width of magnetic flux density of said first magnetic pole, and with respect to the rotational direction of said rotatable developing member, a most downstream end of said cover portion is positioned downstream of the first peak position and upstream of a position where the magnetic flux density of said first magnetic pole is a minimum on a side downstream of the first peak position and upstream of a second peak position where magnetic flux density of said second magnetic pole is a maximum, wherein the following relationship is satisfied:

$L1 \leq L2 + L3$, and $L2 \leq L3$, where with respect to the radial direction of said rotatable developing member, L1 is a minimum of the clearance formed between said second frame and said rotatable developing member, L2 is a minimum of the clearance formed between said rotatable developing member and said cover portion, and L3 is a minimum of the clearance formed between said second frame and said cover portion.

2. The developing device according to claim 1, wherein as seen in the cross section perpendicular to the rotational axial direction of said rotatable developing member in a state that said developing device is in the position where the electrostatic latent image formed on the image bearing member is developed, the most upstream end of said cover portion with respect to the rotational direction of said rotatable developing member is positioned downstream of an uppermost position of said rotatable developing member with respect to a direction of gravitation.

3. The developing device according to claim 1, wherein as seen in the cross section perpendicular to the rotational axial direction of said rotatable developing member in a state that said developing device is in the position where the electrostatic latent image formed on the image bearing member is developed, the most downstream end of said cover portion with respect to the rotational direction of said rotatable developing member is positioned within a range of the half-width of the magnetic flux density of said first magnetic pole.

4. The developing device according to claim 1, wherein said magnet further includes a third magnetic pole which is provided adjacently to said first magnetic pole on a side upstream of the first peak position with respect to the rotational direction of said rotatable developing member and which has a polarity different from the polarity of said first magnetic pole, wherein as seen in the cross section perpendicular to the rotational axial direction of said rotatable developing member in a state that said developing device is in the position where the electrostatic latent image formed on the image bearing member is developed, with respect to the rotational direction of said rotatable developing member, the most upstream end of said cover portion is positioned upstream of a position where the magnetic flux density is a minimum on a side upstream of the first peak position and downstream of a third peak position where magnetic flux density of said third magnetic pole is a maximum.

5. The developing device according to claim 1, wherein said magnet further includes a third magnetic pole which is provided adjacently to said first magnetic pole on a side upstream of the first peak position with respect to the rotational direction of said rotatable developing member and which has a polarity different from the polarity of said first magnetic pole, wherein as seen in the cross section perpendicular to the rotational axial direction of said rotatable developing member in a state that said developing device is in the position where the electrostatic latent image formed on the image bearing member is developed, with respect to the rotational direction of said rotatable developing member, the most upstream end of said cover portion is positioned downstream of a third peak position where magnetic flux density of said third magnetic pole is a maximum.

6. The developing device according to claim 1, wherein

L2 is 1.5mm to 3.0mm, and

L3 is 2.0mm to 3.5mm.

* * * * *